US010302077B2

(12) United States Patent
Sakai

(10) Patent No.: US 10,302,077 B2
(45) Date of Patent: May 28, 2019

(54) LIQUID SUPPLY SYSTEM AND METHOD FOR CONTROLLING LIQUID SUPPLY SYSTEM

(71) Applicant: CKD Corporation, Komaki-shi, Aichi (JP)

(72) Inventor: Atsuyuki Sakai, Komaki (JP)

(73) Assignee: CKD Corporation, Komaki-shi (JP)

( * ) Notice: Subject to any disclaimer, the term of this patent is extended or adjusted under 35 U.S.C. 154(b) by 308 days.

(21) Appl. No.: 15/178,449

(22) Filed: Jun. 9, 2016

(65) Prior Publication Data

US 2016/0363118 A1 Dec. 15, 2016

(30) Foreign Application Priority Data

Jun. 11, 2015 (JP) ..... 2015-118732
May 11, 2016 (JP) ..... 2016-095074

(51) Int. Cl.
*F04B 43/02* (2006.01)
*F04B 43/06* (2006.01)
(Continued)

(52) U.S. Cl.
CPC ..... *F04B 49/22* (2013.01); *F04B 43/02* (2013.01); *F04B 43/06* (2013.01); *F04B 43/073* (2013.01);
(Continued)

(58) Field of Classification Search
CPC ..... F04B 49/22; F04B 43/073; F04B 43/06; F04B 43/02; F04B 53/16; F04B 53/10; F04B 51/00
See application file for complete search history.

(56) References Cited

U.S. PATENT DOCUMENTS 7,686,588 B2 * 3/2010 Okumura ..... F04B 49/08 417/21
7,988,429 B2 * 8/2011 Okumura ..... F04B 43/073 222/207
(Continued)

FOREIGN PATENT DOCUMENTS

JP 2006-046284 A 2/2006
JP 2007-051563 A 3/2007
(Continued)

OTHER PUBLICATIONS

English Translation of JP2012017658A Description dated Jan. 26, 2012 (Year: 2012).*

*Primary Examiner* — Nathan C Zollinger
(74) *Attorney, Agent, or Firm* — Beyer Law Group LLP

(57) ABSTRACT

A liquid supply system includes a pump having a fluctuating member separating pump and working chambers thereof, a supply and discharge section which supplies a working gas to the working chamber and discharges the working gas from the working chamber, a suction valve, a discharge valve, a pressure sensor for detecting the pressure within a space including the working chamber, a flow rate sensor for detecting the flow rate of the working gas, and a control section. The control section closes the discharge valve and opens the suction valve, calculates a change in the volume of the working chamber from the detected flow rate, controls the supply and discharge section such that the volume change becomes zero, and uses, as an estimated suction-side hydraulic head pressure of the liquid, the pressure detected in a state in which the volume change has becomes zero.

18 Claims, 12 Drawing Sheets

(51) Int. Cl.

| | |
|---|---|
| ***F04B 49/22*** | (2006.01) |
| ***F04B 51/00*** | (2006.01) |
| ***F04B 53/10*** | (2006.01) |
| ***F04B 53/16*** | (2006.01) |
| ***F04B 43/073*** | (2006.01) |

(52) U.S. Cl.
CPC ..... *F04B 51/00* (2013.01); *F04B 53/10* (2013.01); *F04B 53/16* (2013.01)

(56) References Cited

U.S. PATENT DOCUMENTS

| | | | | |
|---|---|---|---|---|
| 8,636,477 | B2 * | 1/2014 | Nagasaki | F04B 43/073 417/21 |
| 9,719,504 | B2 * | 8/2017 | Vines | F04B 49/22 |
| 2007/0122291 | A1 * | 5/2007 | Okumura | F04B 49/08 417/46 |
| 2007/0177998 | A1 * | 8/2007 | Kato | F04B 7/02 417/395 |
| 2011/0240672 | A1 * | 10/2011 | Nagasaki | F04B 43/073 222/63 |

FOREIGN PATENT DOCUMENTS

| | | | | |
|---|---|---|---|---|
| JP | 2012-017658 | A | | 1/2012 |
| JP | 2012017658 | A | * | 1/2012 |
| JP | 5342489 | B | | 8/2013 |
| JP | 2014-238092 | A | | 12/2014 |
| KR | 10-2007-0042094 | A | | 4/2007 |

* cited by examiner

FIG. 6

(a) Formula For Calculating Working Chamber Volume $$V(n+1) = V(n) + Q_v(n+1) \cdot \Delta t$$

$$= V(0) + \sum_{k=1}^{n+1} Q_V(k) \cdot \Delta t \quad \cdots F1$$

$V(0)$: Initial Volume (b) Unit-Time Volume Change (Working Chamber Pressure)

$$Q_V(n+1) = \frac{P0}{P(n+1)} \cdot Q_M(n+1) \quad \cdots F2$$

$P0$ : Reference Pressure
$P(n+1)$: Detected Pressure (c) Unit-Time Volume Change (Reference Pressure)

$$Q_M(n+1) = Q_A(n+1) - Q_P(n+1) \quad \cdots F3$$

$Q_A(n+1)$ : Detected Flow Rate (d) Pressure Change Corresponding Flow Rate $$Q_P(n+1) = V \cdot \frac{P(n+1) - P(n)}{P0} \cdot \frac{1}{\Delta t} \quad \cdots F4$$

V : Operation Chamber Volume (Working Chamber Volume + Pipe Volume)

(e) $$V = Q_A(n+1) \cdot \frac{P0}{\Delta P(n+1)} \cdot \frac{\Delta t}{1} \quad \cdots F5$$

V : Operation Chamber Volume (Working Chamber Volume + Pipe Volume)
$Q_A(n+1)$: Detected Flow Rate VL: Dischargeable Liquid Volume Vk: Bubble Volume Vs: Operation Chamber Volume $P1 < P2$ $Vs1 < Vs2$ Formula For Calculating Bubble Volume $$\begin{cases} P1 \cdot Vk1 = P2 \cdot Vk2 \\ Vk1 - Vk2 = Vs2 - Vs1 \end{cases}$$

$$Vk2 = (P1/P2) \cdot Vk1$$

$$Vk1 - (P1/P2) \cdot Vk1 = Vs2 - Vs1$$

$$Vk1 \cdot (1 - P1/P2) = Vs2 - Vs1$$

$$Vk1 = \{P2/(P2 - P1)\} \cdot (Vs2 - Vs1)$$

LIQUID SUPPLY SYSTEM AND METHOD FOR CONTROLLING LIQUID SUPPLY SYSTEM

CLAIM OF PRIORITY

This application claims priority to Japanese Patent Application No. 2015-118732 filed on Jun. 11, 2015 and Japanese Patent Application No. 2016-095074 filed May 11, 2016, which are hereby incorporated by reference.

BACKGROUND OF THE INVENTION

Field of the Invention

The present invention relates to a liquid supply system which supplies liquid through use of a pump.

Description of the Related Art

Conventionally, there has been known a chemical supply system in which a working chamber and a pump chamber of a pump are separated from each other by a diaphragm, and air serving as a working fluid is supplied to and discharged from the working chamber so as to change the volume of the pump chamber, to thereby discharge and suck a chemical solution (see Japanese Patent No. 5342489). In the chemical supply system disclosed in the patent, when charging of the chemical solution into the pump chamber is started, the hydraulic head pressure of the chemical solution is estimated. Specifically, in a state in which the working chamber is closed so as to serve as a closed space, an open-close valve in a suction-side passage communicating with the pump chamber and an open-close valve in a discharge-side passage communicating with the pump chamber are brought into the closed state, and the open-close valve in the suction-side passage is then brought into the open state. Subsequently, the pressure within the working chamber which increases as a result of flow of the chemical solution into the pump chamber is detected, and the maximum value of the detected pressure is used as the estimated hydraulic head pressure.

However, in the case of the chemical supply system disclosed in the patent, it is necessary to wait until the pressure within the working chamber reaches the maximum value, and estimation of the hydraulic head pressure cannot be performed quickly.

SUMMARY OF THE INVENTION

The present invention has been accomplished in view of the above-described problem, and its main object is to provide a liquid supply system which can quickly estimate the hydraulic head pressure of liquid.

In order to solve the above problems, the present invention provides the following aspects:

A first aspect is a liquid supply system comprising a pump, a supply and discharge section, a supply and discharge section, a suction valve, a discharge valve, a pressure sensor, a flow rate sensor, and a control section.

The pump includes a pump chamber into which a liquid supplied from a liquid container flows and from which the liquid flows out, a working chamber into which a working gas is supplied and from which the working gas is discharged, and a fluctuating member which separates the pump chamber and the working chamber from each other, the pump is being configured to suck and discharge the liquid in accordance with change in a volume of the pump chamber caused by fluctuation of the fluctuating member.

The supply and discharge section is configured to supply the working gas to the working chamber and discharge the working gas from the working chamber.

The suction valve is configured to open and close an inflow passage through which the liquid flows into the pump chamber, and the discharge valve is configured to open and close a discharge passage through which the liquid flows out of the pump chamber.

The pressure sensor is configured to detect pressure within a space including the working chamber, and the flow rate sensor is configured to detect flow rate of the working gas which flows into and flows out of the working chamber.

The control section is configured to control the supply and discharge section, the suction valve, and the discharge valve, wherein the control section is further configured to close the discharge valve and open the suction valve, calculate a change in a volume of the working chamber on the basis of the flow rate detected by the flow rate sensor, control the supply and discharge section such that the change in the volume becomes zero, and use, as an estimated suction-side hydraulic head pressure of the liquid, the pressure detected by the pressure sensor in a state in which the change in the volume has become zero.

According to the above-described configuration, in the pump, the pump chamber and the working chamber are separated from each other by the fluctuating member. The liquid supplied from the liquid container flows into the pump chamber and flows out of the pump chamber. The working gas is supplied to the working chamber and is discharged from the working chamber by the supply and discharge section. As a result of change in the volume of the pump chamber caused by fluctuation of the fluctuating member, the liquid is sucked and discharged.

The inflow passage through which the liquid flows into the pump chamber is opened and closed by the suction valve. The discharge passage through which the liquid flows out of the pump chamber is opened and closed by the discharge valve. Also, the pressure of the space including the working chamber is detected by the pressure sensor. The flow rate of the working gas which flows into and flows out of the working chamber is detected by the flow rate sensor.

The supply and discharge section, the suction valve, and the discharge valve are controlled by the control section. Specifically, since the discharge valve is closed and the suction valve is opened by the control section, the liquid flows into the pump chamber through the inflow passage. The fluctuating member is fluctuated by the liquid within the pump chamber, whereby the volume of the working chamber is changed. At that time, the change in the volume of the working chamber is calculated on the basis of the flow rate detected by the flow rate sensor. For example, the integrated flow rate (volume) of the working gas flowing into the working chamber can be considered to be equal to an increase in the volume of the working chamber.

Further, the supply and discharge section is controlled by the control section such that the change in the volume of the working chamber becomes zero, and the working gas is supplied to and discharged from the working chamber by the supply and discharge section. As a result, the change in the volume of the working chamber is quickly decreased to zero. In a state in which the discharge valve is closed, the suction valve is opened, and the change in the volume of the working chamber has become zero, the pressure within the space including the working chamber is equal to the suction-side hydraulic head pressure of the liquid. Therefore, the pressure detected by the pressure sensor in the state in which the change in the volume of the working chamber has become zero is used as an estimated suction-side hydraulic head pressure of the liquid. Accordingly, the hydraulic head pressure of the liquid can be estimated quickly.

BRIEF DESCRIPTION OF THE DRAWINGS

FIG. 6 is a set of formulas for calculating the volume of the working chamber of the pump from the pressure and flow rate of operation air;

DESCRIPTION OF THE PREFERRED EMBODIMENT

An embodiment of the present invention which is embodied as a chemical supply system used in a semiconductor production line or the like will now be described with reference to the drawings.

Figure 1:
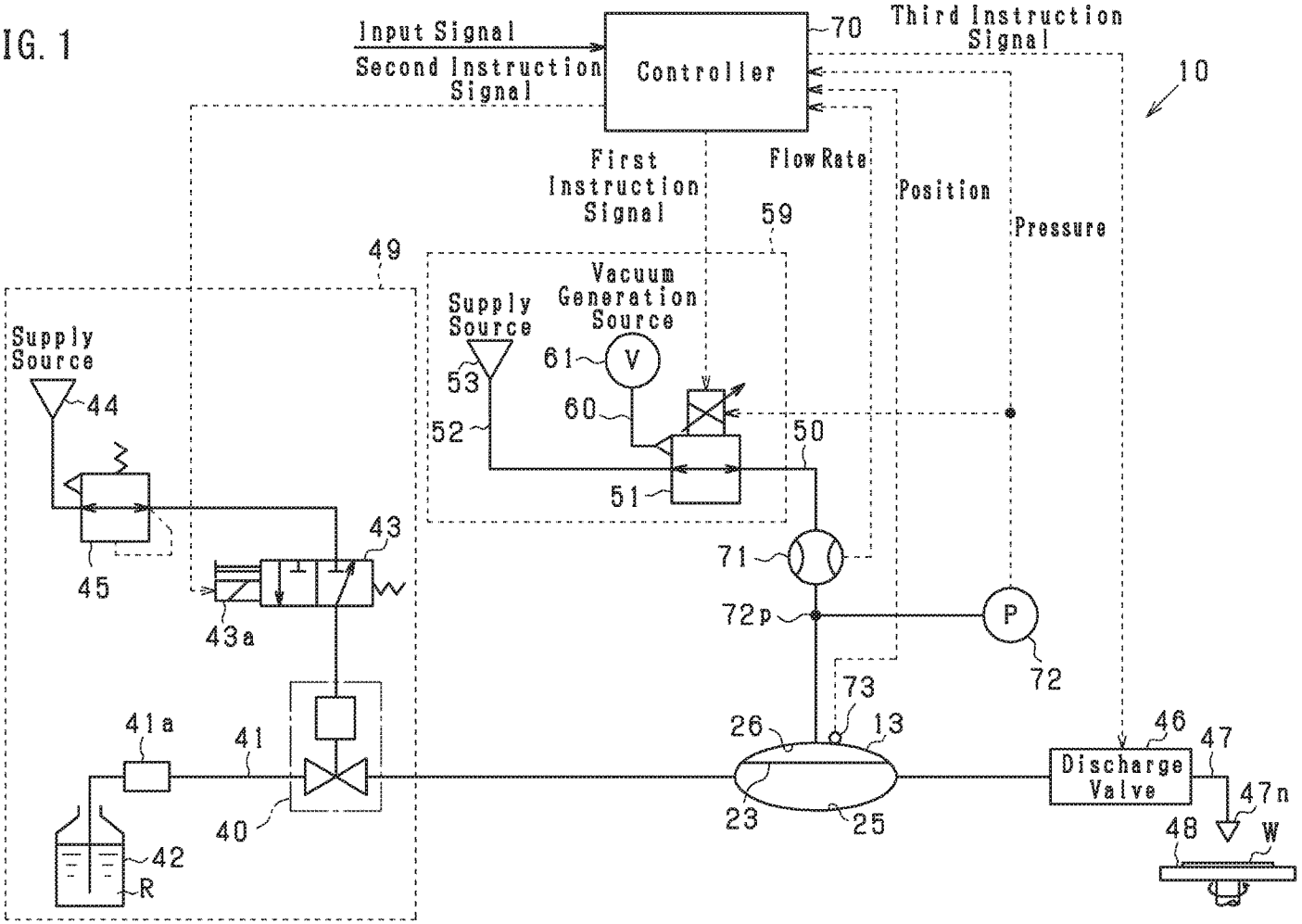
FIG. 1 is a circuit diagram illustrating a chemical supply system.

FIG. 1 is a circuit diagram showing a chemical supply system 10 (liquid supply system). As shown in FIG. 1, the chemical supply system 10 supplies resist solution R, which is a chemical solution (liquid), from an end nozzle 47*n* to an area near the center of a semiconductor wafer W disposed on a rotating plate 48. The resist solution R is spread from the area near the center of the semiconductor wafer W to the circumferential edge of the semiconductor wafer W by centrifugal force.

The chemical supply system 10 includes a diaphragm pump 13, a pump drive section 59, a chemical supply section 49, a suction pipe 41, a discharge pipe 47, a discharge valve 46, a flow rate sensor 71, a pressure sensor 72, a position sensor 73, a controller 70, etc.

The pump 13 has a diaphragm 23 which separates a pump chamber 25 and a working chamber 26 from each other. The resist solution R is sucked into the pump chamber 25 through the suction pipe 41, and then discharged from the pump chamber 25 to the discharge pipe 47. Operation air is supplied to and discharged from the working chamber 26. FIG. 1 schematically illustrates the pump 13.

The pump drive section 59 (supply and discharge section) includes a supply source 53 which supplies pressurized operation air (working gas), a vacuum generation source 61 which generates a negative pressure, an electro-pneumatic regulator 51, etc.

The operation air is supplied from the supply source 53 to the electro-pneumatic regulator 51 through a supply pipe 52. The operation air is discharged from the electro-pneumatic regulator 51 through a discharge pipe 60 to the vacuum generation source 61. The electro-pneumatic regulator 51 has a solenoid valve, etc. and switches a to-be-used source between the supply source 53 and the vacuum generation source 61. The operation air is supplied to the working chamber 26 of the pump 13 from the electro-pneumatic regulator 51 through an air supply pipe 50 (a working gas passage). The operation air is discharged from the working chamber 26 of the pump 13 to the electro-pneumatic regulator 51 through the air supply pipe 50. In response to a first instruction signal (for example, a target pressure) from the controller 70, the electro-pneumatic regulator 51 controls the pressure of the operation air to a set pressure, which is the target pressure. The pump drive section 59 is not limited to that including the electro-pneumatic regulator 51, and may be a circuit of any other type for controlling the pressure of the operation air.

The chemical supply section 49 includes a resist bottle 42 which stores the resist solution R, a suction valve 40, a supply source 44 which supplies pressurized operation air, a pressure-adjusting valve 45, a switching valve 43, etc.

The resist bottle 42 (liquid container) is connected by the suction pipe 41 (inflow passage) to the suction valve 40 with a filter 41*a* disposed in the suction pipe 41. The resist bottle 42 may be located at a higher or lower position than the pump chamber 25. The filter 41*a* removes impurities such as minute particles contained in the resist solution R. The suction valve 40 opens and closes the suction pipe 41. The operation air is supplied from the supply source 44 to the suction valve 40 through the pressure-adjusting valve 45 and the switching valve 43. The pressure-adjusting valve 45 adjusts the pressure of the operation air supplied from the supply source 44 to a pressure for operating the suction valve 40. The switching valve 43 is a solenoid valve for switching the connection state of the flow passage by an electromagnetic switching section 43*a* having an electromagnetic solenoid. In response to a second instruction signal (for example, ON instruction or OFF instruction) from the controller 70, the switching valve 43 switches the connection state of the flow passage alternatingly between a state in which the operation air is supplied to the suction valve 40 and a state in which the suction valve 40 communicates with the atmosphere. The resist solution R flows into the pump chamber 25 of the pump 13 through the suction pipe 41 when the suction valve 40 is opened.

The pump chamber 25 of the pump 13 is connected by the discharge pipe 47 (outflow passage) to the end nozzle 47*n* through the discharge valve 46. The discharge valve 46 has the same structure as the suction valve 40 described above. In response to a third instruction signal (for example, ON instruction or OFF instruction) from the controller 70, the discharge valve 46 is switched alternatingly between an open state and a closed state. The resist solution R flows out of the pump chamber 25 of the pump 13 through the discharge pipe 47 when the discharge valve 46 is opened. Thus, the resist solution R is supplied to the end nozzle 47*n* through the discharge pipe 47.

The flow rate sensor 71 detects the flow rate of the operation air which flows through the air supply pipe 50; namely, the flow rate of the operation air which flows into or flows out of the working chamber 26 of the pump 13.

The pressure sensor 72 detects the pressure of the operation air inside the air supply pipe 50; namely, the pressure within the space including the working chamber 26 and the air supply pipe 50. Specifically, the pressure sensor 72 detects the pressure at a pressure detection point 72*p* provided in the air supply pipe 50 between the pump 13 and the flow rate sensor 71.

The position sensor 73 detects the position of the diaphragm 23. Specifically, the position sensor 73 enters an off state when the diaphragm 23 is located on the pump chamber 25 side (discharge side) with respect to the neutral position. The position sensor 73 enters an on state when the diaphragm 23 is located at the neutral position or on the working chamber 26 side (suction side) with respect to the neutral position. The neutral position is a position where the tension generated in the diaphragm 23 due to fluctuation of the diaphragm 23 becomes smaller than a predetermined value (for example, the tension becomes zero); namely, a position where the tension generated in the diaphragm can be ignored.

The controller 70 (control section) is an electronic control apparatus mainly composed of a microcomputer which includes a CPU, and various kinds of memories, etc. The controller 70 controls the states of supply and discharge of the resist solution R by the pump 13. The controller 70 receives an input signal (for example, a suction instruction signal or a discharge instruction signal) from an unillustrated administration computer which administers the entirety of the present system. The controller 70 receives a flow rate detection signal from the flow rate sensor 71, a pressure detection signal from the pressure sensor 72, and a position detection signal from the position sensor 73. On the basis of these input signals, the controller 70 controls the open/closed states of the suction valve 40 and the discharge valve 46 and the state of the electro-pneumatic regulator 51 (namely, the pump drive section 59). In the present embodiment, the controller 70 estimates the suction-side hydraulic head pressure and relation coefficient of the resist solution R, the dischargeable amount of the resist solution R, and the discharge-side hydraulic head pressure and relation coefficient of the resist solution R.

Figure 2:
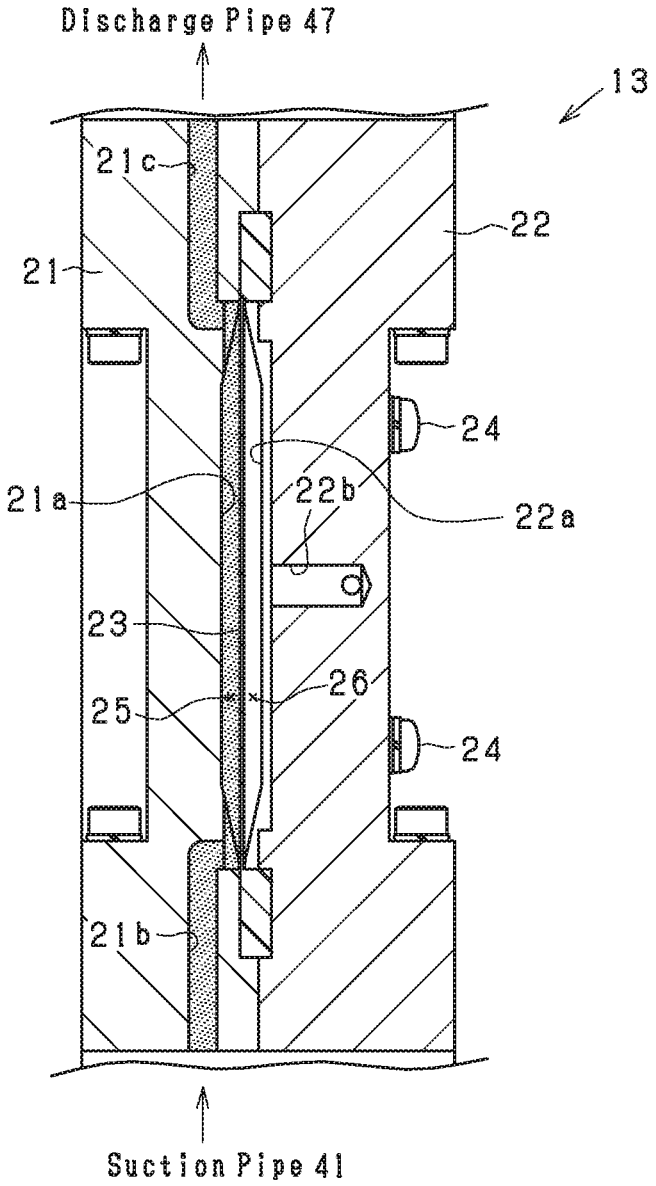
FIG. 2 is a sectional view showing a diaphragm pump.

FIG. 2 is a sectional view showing the diaphragm pump 13. As shown in FIG. 2, the diaphragm pump 13 has a pair of pump housings 21 and 22. These pump housings 21 and 22 have recesses 21*a* and 22*a*, each having a circular cross section. These recesses 21*a* and 22*a* are formed at the centers of the mutually facing surfaces of the pump housings 21 and 22. The diaphragm 23 is composed of a circular flexible film made of fluororesin. The peripheral edge of the diaphragm 23 is held between the pump housings 21 and 22. The pump housings 21 and 22 are fixed to each other by a plurality of screws 24.

The diaphragm 23 partitions the space formed by the recesses 21 and 22*a* inside the pump housings 21 and 22. A portion of the space (partitioned by the diaphragm 23) on the pump housing 21 side (on the left side of the diaphragm 23 in FIG. 2) forms the pump chamber 25 described above. A portion of the space (partitioned by the diaphragm 23) on the pump housing 22 side (on the right side of the diaphragm 23 in FIG. 2) forms the working chamber 26 described above. The pump chamber 25 is a space to be filled with the resist solution R. The working chamber 26 is a space to be filled with the operation air which deforms (i.e., fluctuates) the diaphragm 23.

The pump housing 21 has a suction passage 21*b* (inflow passage) and a discharge passage 21*c* (outflow passage) which communicate with the pump chamber 25. The suction passage 21*b* is connected to the suction pipe 41 described above. The discharge passage 21*c* is connected to the discharge pipe 47 described above. The pump housing 22 has a supply and discharge passage 22*b* which communicates with the working chamber 26. The supply and discharge passage 22*b* is connected to the air supply pipe 50 described above.

Figure 3:
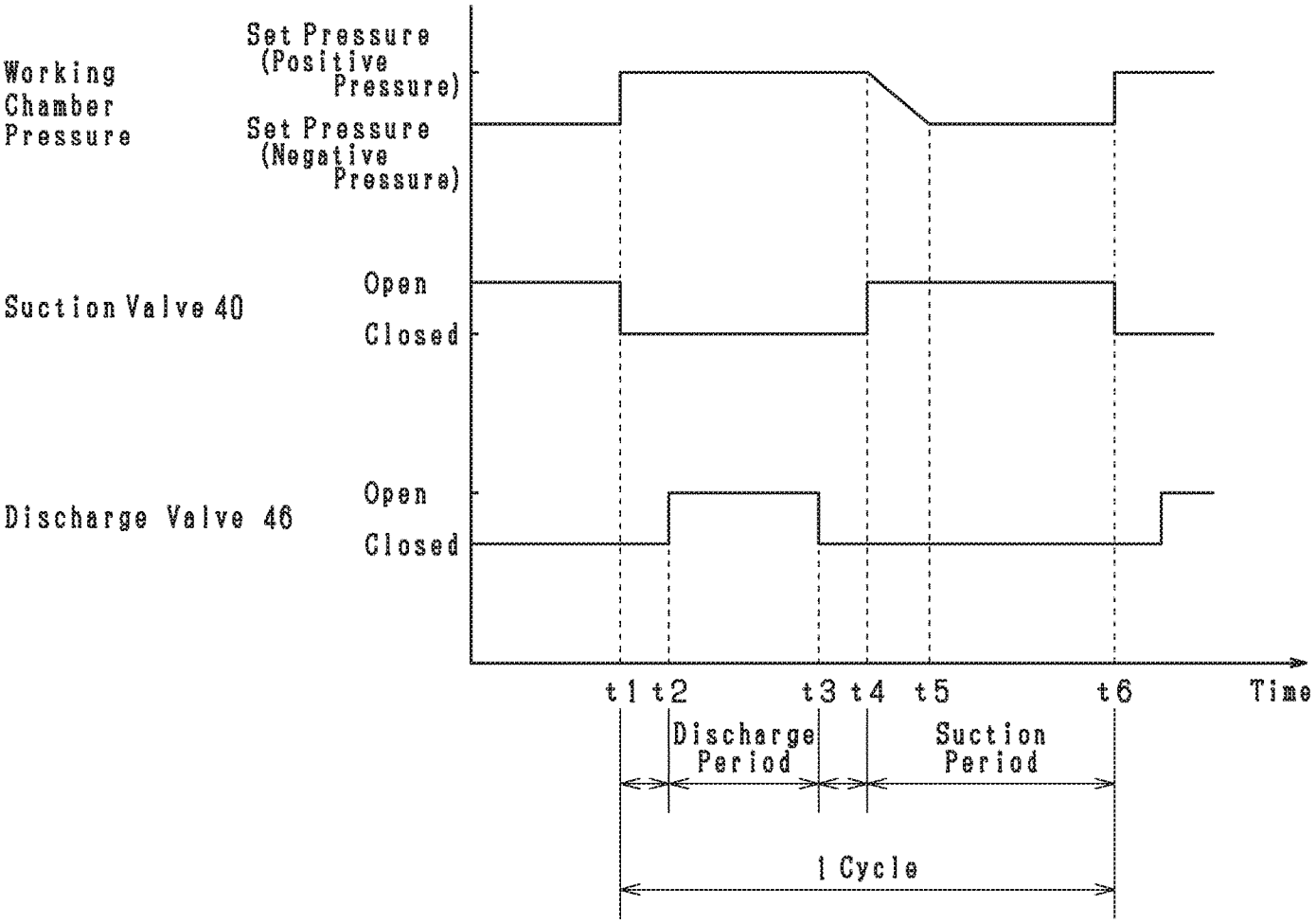
FIG. 3 is a time chart showing the basic operation of the chemical supply system.

FIG. 3 is a time chart showing the basic operation of the chemical supply system 10. The chemical supply system 10 operates by repeating a cycle including discharge of the resist solution R from the pump 13 and suction of the resist solution R into the pump 13. The operation of the chemical supply system 10 is controlled by the controller 70 described above.

As shown in FIG. 3, the suction valve 40 is opened and the discharge valve 46 is closed before time t1. The pressure within the working chamber 26 is a negative pressure which is the set pressure. In this state, the pump chamber 25 has expanded to have the maximum volume, and the working chamber 26 has contracted to have the minimum volume.

At time t1, while the discharge valve 46 remains in the closed state, the suction valve 40 is closed. After the suction valve 40 is closed, the set pressure of the electro-pneumatic regulator 51 is changed to a positive pressure. Consequently, the pressure within the working chamber 26 is quickly controlled to the set positive pressure by the electro-pneumatic regulator 51. In this state, since both the suction valve 40 and the discharge valve 46 are in the closed state, the pump chamber 25 is in a state (specifically, a stationary state) in which a positive pressure (set pressure) is applied from the working chamber 26 side to the pump chamber 25 via the diaphragm 23.

The pressure at the pressure detection point 72*p* (the pressure within the working chamber 26) is detected by the pressure sensor 72 in real time. The flow rate of the operation air that flows into or out of the working chamber 26 is detected by the flow rate sensor 71 in real time. The above-described state is maintained until time t2 at which the flow rate detected by the flow rate sensor 71 becomes smaller than a predetermined value (for example, the flow rate becomes zero). Time t2 may be the time at which fluctuation of the pressure detected by the pressure sensor becomes smaller than a predetermined value (for example, the fluctuation of the pressure becomes zero).

At time t2, the discharge valve 46 is opened. This allows discharge of the resist solution R from the pump chamber 25 through the discharge valve 46. Therefore, when the diaphragm 23 is pressed by the operation air in the direction from the working chamber 26 to the pump chamber 25, the discharge of the resist solution R from the pump chamber 25 is started. This state is maintained during a period during which the working chamber 26 can be expanded to the maximum volume and the pump chamber can be contracted to the minimum volume; namely, a period from time t2 to time t3. Thus, the discharge of the resist solution R from the pump 13 ends.

At time t3, the discharge valve 46 is closed. At time t4 after elapse of a predefined time after t3, the suction valve 40 is opened.

From time t4 to t5, the set pressure of the operation air is not changed rapidly. Rather, it is gradually changed from a positive pressure to a negative pressure at a predetermined rate. This restrains occurrence of a bubble generation phenomenon which occurs when the pressure within the pump chamber 25 decreases rapidly. As the set pressure of the operation air decreases (for example, to a negative pressure), the diaphragm 23 is sucked from the pump chamber 25 side toward the working chamber 26 side. This state is maintained during a period during which the pump chamber 25 can be expanded to the maximum volume and the working chamber 26 can be contracted to the minimum volume; namely, a period from time t5 to time t6. Thus, the suction of the resist solution R into the pump 13 ends. Then, at time t6, the control same as that at time t1 is executed.

Figure 4:
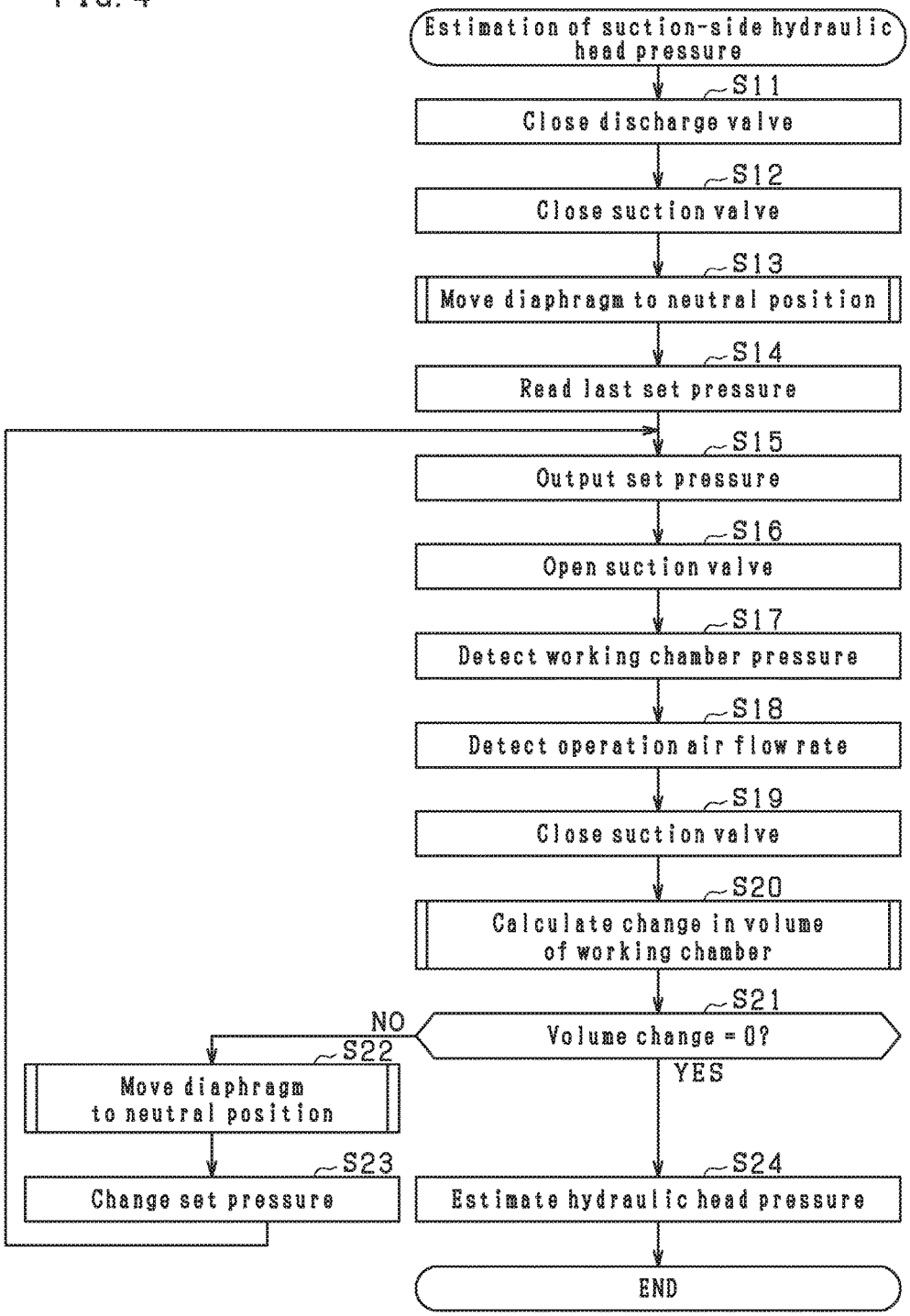
FIG. 4 is a flowchart showing a series of processes for estimating a suction-side hydraulic head pressure.

Estimation of Suction-Side Hydraulic Head Pressure:

FIG. 4 is a flowchart showing a series of processes for estimating the hydraulic head pressure on the suction-side (the suction valve side, a second valve side). The series of processes are executed by the controller 70.

First, the controller 70 closes the discharge valve 46 (corresponding to the first valve) and the suction valve 40 (corresponding to the second valve) (S11 and S12). Namely, both the valves 46 and 40 are closed temporarily.

Subsequently, the controller 70 moves the diaphragm 23 to the neutral position described above (S13). The neutral position is a position where the tension generated in the diaphragm 23 due to fluctuation of the diaphragm 23 becomes smaller than a predetermined value (for example, the tension becomes zero). The details of this process will be described later.

Subsequently, the controller 70 reads the set pressure which was used in the series of processes performed last time (S14). Specifically, the controller 70 reads the set pressure which was output to the electro-pneumatic regulator 51 when the series of processes for estimating the suction-side hydraulic head pressure was performed last time.

Subsequently, the controller 70 outputs the set pressure read in S14 to the electro-pneumatic regulator 51 (S15). As a result, the electro-pneumatic regulator 51 starts an operation of controlling the pressure within the working chamber 26 to the set pressure. The controller 70 then opens the suction valve 40 (S16). Namely, the controller 70 starts the process for estimating the hydraulic head pressure from the state in which the pressure within the working chamber 26 has been controlled to the set pressure in the series of processes performed last time. In the case where the controller 70 cannot acquire the set pressure which was used in the series of processes performed last time, the controller 70 starts the process for estimating the hydraulic head pressure while using a predetermined initial set pressure.

Subsequently, the controller 70 detects the pressure within the working chamber 26 on the basis of the pressure detection signal from the pressure sensor 72 (S17). The controller 70 then detects, on the basis of the flow rate detection signal from the flow rate sensor 71, the flow rate of the working air which flows into or flows out of the working chamber 26 (S18).

Subsequently, the controller 70 closes the suction valve 40 (S19). The controller 70 then calculates the change in the volume of the working chamber 26 on the basis of the detected pressure and flow rate (S20). The details of this process will be described later.

Subsequently, the controller 70 determines whether or not the calculated volume change is zero (S21). Specifically, the controller 70 determines whether or not the calculated volume change is smaller than a determination value. The determination value is determined such that when the calculated volume change is smaller than the determination value, the controller 70 can determine that the change in the volume of the working chamber 26 is substantially zero or approximately zero. For example, the determination value is set to a value slightly greater than zero.

In the case where the controller 70 determines in S21 that the calculated volume change is not zero (S21: NO), the controller 70 moves the diaphragm 23 to the neutral position described above (S22). The controller 70 then changes the set pressure (S23). Specifically, the controller 70 changes the set pressure in accordance with the calculated volume change such that the volume change can quickly become close to zero. For example, in the case where the volume of the working chamber 26 has decreased, the controller 70 raises the set pressure, and in the case where the volume of the working chamber 26 has increased, the controller 70 lowers the set pressure. Further, the controller 70 changes the set pressure such that the greater the rate at which the volume of the working chamber 26 decreases, the greater the degree to which the set pressure is raised and such that the greater the rate at which the volume of the working chamber 26 increases, the greater the degree to which the set pressure is lowered. Subsequently, the controller 70 again executes the series of processes from the process of S15.

Meanwhile, in the case where the controller 70 determines in S21 that the calculated volume change is zero (S21: YES), the controller 70 estimates the suction-side hydraulic head pressure (S24). Specifically, the controller 70 uses, as an estimated suction-side hydraulic head pressure, the set pressure for the working chamber 26 in a state in which the change in the volume of the working chamber 26 has become zero; namely, the pressure detected by the pressure sensor 72 in the state in which the change in the volume of the working chamber 26 has become zero. After that, the controller 70 ends the series of processes (END). The series of processes correspond to the method for controlling the liquid supply system.

Figure 5:
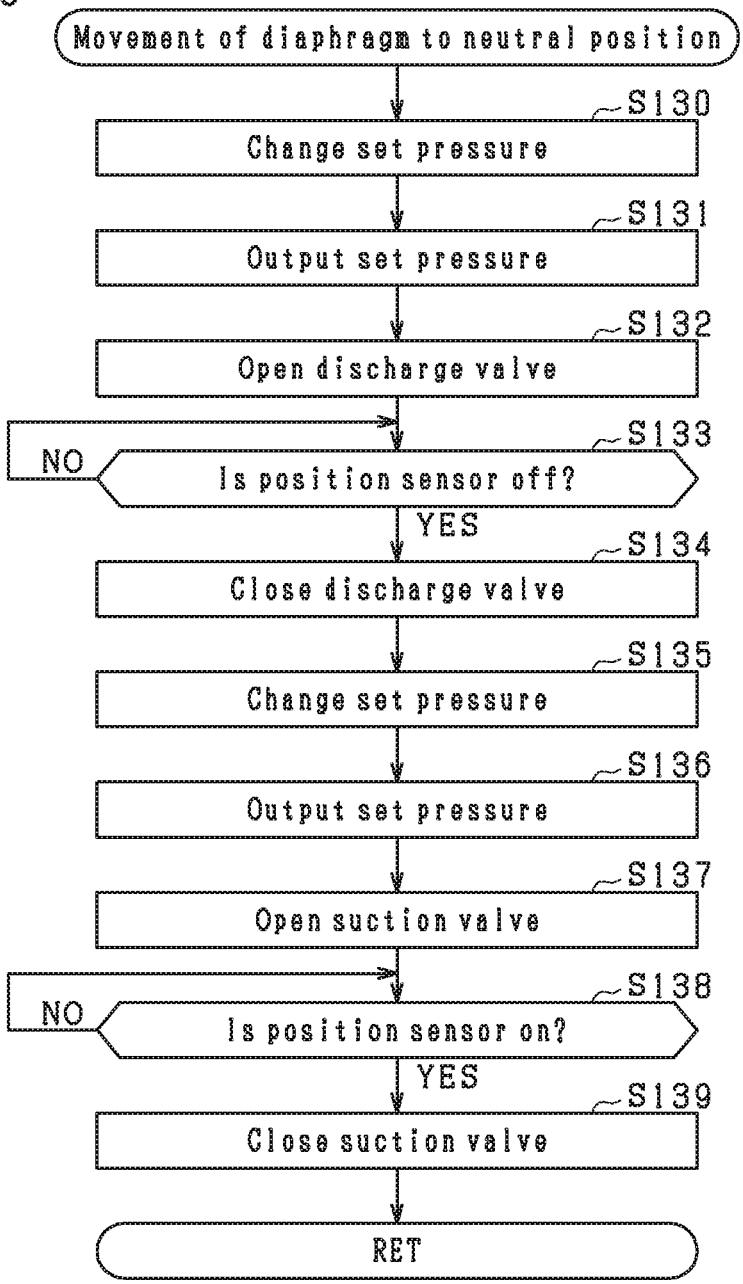
FIG. 5 is a flowchart showing a series of processes for moving the diaphragm of the pump to a neutral position.

Movement of Diaphragm to Neutral Position:

FIG. 5 is a flowchart showing the series of processes for moving the diaphragm 23 to the neutral position (S13 in FIG. 4). The series of processes are executed by the controller 70.

First, the controller 70 changes the set pressure for the working chamber 26 (S130). Specifically, the controller 70 changes the set pressure to a predetermined pressure at which the diaphragm 23 can be quickly fluctuated toward the pump chamber 25 side with respect to the neutral position. The controller 70 then outputs the changed set pressure to the electro-pneumatic regulator 51 (S131). Thus, the electro-pneumatic regulator 51 controls the pressure within the working chamber 26 to the set pressure.

Subsequently, the controller 70 opens the discharge valve 46 (S132). Notably, the suction valve 40 has already been closed in the process of S12 in FIG. 4.

Subsequently, the controller 70 determines whether or not the position sensor 73 has entered the off state (S133). Specifically, the controller 70 determines whether or not the diaphragm 23 has moved to the pump chamber 25 side with respect to the neutral position. In the case where the controller 70 determines that the position sensor 73 has not yet entered the off state (S133: NO), the controller 70 waits by repeatedly executing the determination in S133.

Meanwhile, in the case where the controller 70 determines in S133 that the position sensor 73 has entered the off state (S133: YES), the controller 70 closes the discharge valve 46 (S134), and changes the set pressure for the working chamber 26 (S135). Specifically, the controller 70 changes the set pressure to a predetermined pressure at which the diaphragm 23 can be moved to the neutral position at a proper speed. The predetermined pressure is set to a pressure at which the diaphragm 23 can be moved to the neutral position without fail and the diaphragm 23 does not fluctuate greatly toward the working chamber 26 side with respect to the neutral position. The controller 70 then outputs the changed set pressure to the electro-pneumatic regulator 51 (S136). Thus, the electro-pneumatic regulator 51 controls the pressure within the working chamber 26 to the set pressure.

Subsequently, the controller 70 opens the suction valve 40 (S137).

Subsequently, the controller 70 determines whether or not the position sensor 73 has entered the on state (S138). Specifically, the controller 70 determines whether or not the diaphragm 23 has moved to the neutral position. In the case where the controller 70 determines that the position sensor 73 has not yet entered the on state (S138: NO), the controller 70 waits by repeatedly executing the determination in S138.

Meanwhile, in the case where the controller 70 determines in S138 that the position sensor 73 has entered the on state (S138: YES), the controller 70 closes the suction valve 40 (S139). Thus, the diaphragm 23 stops at the neutral position. The controller 70 then returns to the process of S13 and subsequent processes in FIG. 4 (RET).

Calculation of Change in Volume of Working Chamber:

FIG. 6 is a set of formulas for calculating the volume of the working chamber of the pump 13 from the pressure and flow rate of the operation air. The formulas are used in the process of S20 in FIG. 4. Formulas F1 to F4 in FIG. 6 are used for calculating the change in the volume of the working chamber 26, in a state in which both the pressure and volume of the working chamber 26 change, through use of the pressure and flow rate of the operation air supplied to the working chamber 26 and in consideration of compressibility of the operation air.

Formula F1 is used for calculating the volume of the working chamber 26 at the present moment (n+1). Specifically, formula F1 is used for calculating the volume V(n+1) of the working chamber 26 at the present moment (n+1) by adding, to the volume V(n) of the working chamber 26 at the previous moment (n), a change in the volume of the working chamber 26 during a predetermined sampling interval of Δt, which change is represented by Qv(n+1)·Δt. Namely, the volume V(n+1) is calculated by adding, to an initial volume V(0) of the working chamber 26, a change in the volume of the working chamber 26 during each sampling interval of Δt, which change is represented by Qv(k)·Δt. The initial volume V(0) is the initial value for the volume of the working chamber 26 at the beginning of the discharge step or the suction step. For example, the initial volume V(0) in a state in which the diaphragm 23 has moved to the discharge-side end, the initial volume V(0) in a state in which the diaphragm 23 is at the neutral position, and the initial volume (0) in a state in which the diaphragm 23 has moved to the suction-side end are known. The volume change ΔV during the time Δt can be calculated by subtracting V(n) from V(n+1). Notably, the volume change ΔV is equal to the amount of the resist solution R discharged during the interval of Δt. This is because the magnitude of the change in the volume of the pump chamber 25 is the same as the magnitude of the change in the volume of the working chamber 26 although the sign of the change in the volume of the pump chamber 25 is reversal of the sign of the change in the volume of the working chamber 26.

Formula F2 is used for calculating the unit-time volume change Qv(n+1) of the working chamber 26 at the present detected pressure P(n+1) (the pressure within the working chamber 26 detected at the present moment (n+1)) from the flow rate QM(n+1) at a reference pressure P0. The detected pressure P(n+1) is the pressure within the working chamber 26 detected by the pressure sensor 72. The unit-time volume change means the flow rate. Thus, the flow rate detected at the assumed reference pressure P0 can be converted to the flow rate at the pressure P(n+1) and used. The volume change Qv(n+1) calculated from Formula F2 is substituted in Formula F1.

Formula F3 is used for calculating the flow rate QM(n+1) at the reference pressure P0 through use of the detected flow rate QA(n+1). The detected flow rate QA(n+1) is the flow rate of the operation air detected by the flow rate sensor 71. The flow rate QM(n+1) at the reference pressure P0 is calculated by subtracting a pressure change corresponding flow rate QP(n+1) from the detected flow rate QA(n+1). The pressure change corresponding flow rate QP(n+1) is a flow rate which contributes to the change in the pressure within the working chamber 26 and does not contribute to the change in the volume of the working chamber 26. The pressure change corresponding flow rate QP(n+1) is also called the compression flow rate. The flow rate QM(n+1) at the reference pressure P0 calculated by Formula F3 is substituted in Formula F2.

Formula F4 is used for calculating the pressure change corresponding flow rate QP(n+1). The pressure change corresponding flow rate QP(n+1) is a portion of the flow rate of the operation air which contributes only to the change in the pressure within the working chamber 26. The pressure change corresponding flow rate QP(n+1) assumes a positive value when the pressure within the working chamber 26 is increasing and assumes a negative value when the pressure within the working chamber 26 is decreasing. The pressure change (P(n+1)−P(n)) is the change in the pressure detected by the pressure sensor 72 during the sampling interval Δt. The actually measured value of the pressure change (P(n+1)−P(n)) may be used as is. Alternatively, the average of the measured values of the pressure change (P(n+1)−P(n)) within a predetermined time period may be used. The calculated value of the pressure change corresponding flow rate QP(n+1) depends on the operation chamber volume V which is the sum of the volume V(n) of the working chamber 26 at that time and the volume of the air supply pipe 50. Therefore, the operation chamber volume V at the time of calculation of the pressure change corresponding flow rate QP(n+1) has an important meaning. For example, the operation chamber volume V in the state in which the diaphragm 23 has moved to the discharge-side end, the operation chamber volume V in the state in which the diaphragm 23 is located at the neutral position, and the operation chamber volume V in the state in which the diaphragm 23 has moved to the suction-side end are known. The pressure change corresponding flow rate QP(n+1) calculated by Formula F4 is substituted in Formula F3. As described above, the volume change ΔV during the interval of Δt can be calculated through use of Formula F1.

Figure 7:
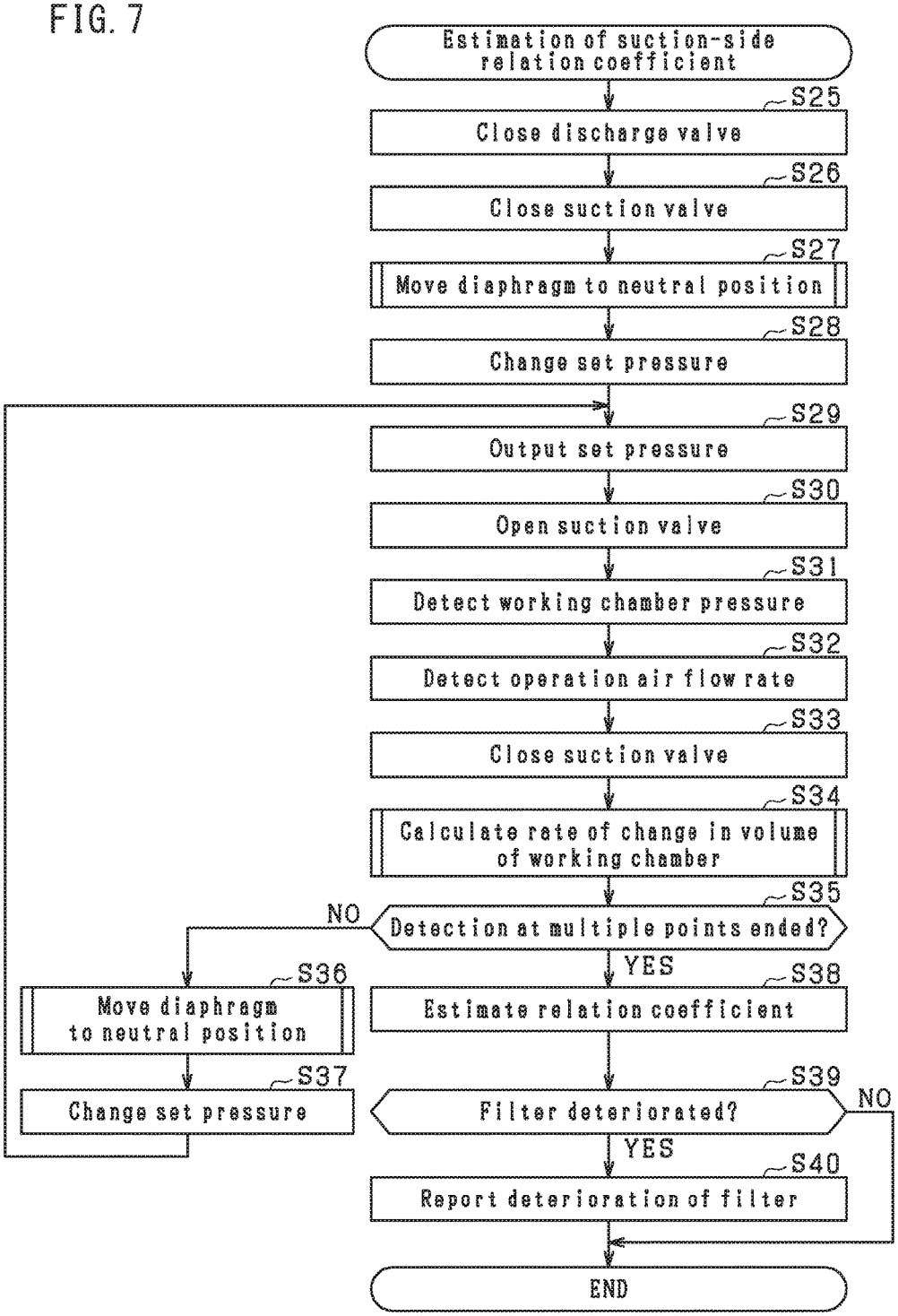
FIG. 7 is a flowchart showing a series of processes for estimating a suction-side relation coefficient.

Estimation of Suction-Side Relation Coefficient:

FIG. 7 is a flowchart showing a series of processes for estimating the relation coefficient on the suction-side (the suction valve side or the second valve side). The series of processes are executed by the controller 70.

The processes of S25 and S26 are the same as the processes of S11 and S12 of FIG. 4.

Subsequently, the controller 70 moves the diaphragm 23 to the neutral position described above (S27).

Subsequently, the controller 70 changes the set pressure for the working chamber 26 (S28). Specifically, the controller 70 changes the set pressure to a predetermined pressure at which the diaphragm 23 can be fluctuated from the pump chamber 25 side to the working chamber 26 side at a proper speed. This predetermined pressure is set to a pressure at which the diaphragm 23 can be moved from the pump chamber 25 side to the working chamber 26 side without fail and the diaphragm 23 can be fluctuated at a speed lower than a predetermined speed.

Subsequently, the controller 70 outputs to the electro-pneumatic regulator 51 the set pressure changed in S28 (S29). As a result, the electro-pneumatic regulator 51 starts an operation of controlling the pressure within the working chamber 26 to the set pressure. The controller 70 then opens the suction valve 40 (S30).

The processes of S31 and S32 are the same as the processes of S17 and S18 of FIG. 4.

Subsequently, the controller 70 closes the suction valve 40 (S33). The controller 70 then calculates the rate of change in the volume of the working chamber 26 (S34). Through use of Formula F2 of FIG. 6, the controller 70 calculates the rate of change in the volume of the working chamber 26 as the unit-time volume change Qv(n+1) of the working chamber 26 at the present detected pressure P(n+1).

Subsequently, the controller 70 determines whether or not the pressure within the working chamber 26 and the flow rate of the operation air have been detected at a plurality of points (S35). Specifically, the controller 70 determines whether or not the pressure within the working chamber 26 and the flow rate of the operation air have been detected at a plurality of positions when the diaphragm 23 is moved to a predetermined position, or at a plurality of points in time during fluctuation of the diaphragm 23. The number of the plurality of points is at least two, and the greater the number of the points, the higher the accuracy with which the relation coefficient can be estimated.

In the case where the controller 70 determines in S35 that the pressure within the working chamber 26 and the flow rate of the operation air have not been detected at the plurality of points (S35: NO), the controller 70 moves the diaphragm 23 to the neutral position described above (S36). The controller 70 then changes the set pressure for the working chamber 26 (S37). The controller 70 again changes the set pressure which has been changed in S28. Namely, the controller 70 changes the pressure within the working chamber 26 and the flow rate of the operation air by changing the set pressure. Subsequently, the controller 70 again executes the series of processes from the process of S29.

Meanwhile, in the case where the controller 70 determines in S35 that the pressure within the working chamber 26 and the flow rate of the operation air have been detected at the plurality of points (S35: YES), the controller 70 estimates a suction-side relation coefficient (S38). Specifically, for example, in the case where the controller 70 has detected the pressure within the working chamber 26 and the flow rate of the operation air at two points which are separated from each other by the time of the sampling interval Δt, the controller 70 calculates the suction-side relation coefficient in accordance with the following expression:

$$R(n+1)=\{Qv(n+1)-Qv(n)\}/\{P(n+1)-P(n)\}.$$

In the expression, R(n+1) represents the relation coefficient (namely, a coefficient reflecting the pressure loss) at the present moment (n+1); P(n) represents the detected pressure at the first point; P(n+1) represents the detected pressure at the second point; Qv(n) represents the rate of change in the volume of the working chamber 26 at the first point; and Qv(n+1) represents the rate of change in the volume of the working chamber 26 at the second point. Notably, in the case where the pressure within the working chamber 26 and the flow rate of the operation air have been detected at three or more points, the controller 70 calculates an approximate line which represents the relation between the detected pressure and the rate of change in the volume and calculates the relation coefficient R(n+1) from the inclination of the approximate line.

Subsequently, the controller 70 determines whether or not the filter 41*a* has deteriorated on the basis of the estimated suction-side relation coefficient (S39). Specifically, in the case where the calculated relation coefficient R(n+1) is smaller than a determination value, the controller 70 determines that the filter 41*a* has deteriorated. The determination value is set in accordance with the characteristics of the filter 41*a*.

In the case where the controller 70 determines in S39 that the filter 41*a* has not yet deteriorated (S39: NO), the controller 70 ends the series of processes (END). Meanwhile, in the case where the controller 70 determines in S39 that the filter 41*a* has deteriorated (S39: YES), the controller 70 notifies a user of the fact that the filter 41*a* has deteriorated (S40). Specifically, the controller 70 turns on a warning lamp for prompting the user to exchange the filter 41*a* or displays the degree of deterioration of the filter 41*a* (e.g., the value of the relation coefficient R(n+1)). After that, the controller 70 ends the series of processes (END).

In the chemical supply system 10, when the amount of the resist solution R within the resist bottle 42 changes as a result of use of the resist solution R, the suction-side hydraulic head pressure of the resist solution R changes. Also, when the operation period of the chemical supply system becomes long, due to, for example, deterioration of the filter 41*a*, the suction-side pressure loss of the resist solution R changes, and the suction-side relation coefficient changes accordingly. In the pump 13, the relation between the pressure within the space (i.e., the operation chamber) including the working chamber 26 and the air supply pipe 50 and the suction amount of the resist solution R changes in accordance with the suction-side hydraulic head pressure of the resist solution R and the suction-side relation coefficient thereof.

In view of this, the controller 70 changes the set pressure (i.e., the target pressure of the space including the working chamber 26 and the air supply pipe 50) at the time of suction of the resist solution R on the basis of the estimated suction-side hydraulic head pressure and the estimated suction-side relation coefficient. The controller 70 then controls the electro-pneumatic regulator 51 (namely, the pump drive section 59) such that the pressure detected by the pressure sensor 72 becomes equal to the set pressure. For example, the controller 70 lowers the set pressure (namely, increases the negative pressure) at the time of suction of the resist solution R into the pump 13 as the suction-side hydraulic head pressure of the resist solution R decreases. The controller 70 lowers the set pressure at the time of suction of the resist solution R into the pump 13 as the suction-side relation coefficient of the resist solution R becomes smaller. Specifically, the relation of the required flow rate=R(n+1)×(the hydraulic head pressure−the set pressure) is satisfied (the set pressure is negative). Therefore, the set pressure is changed in accordance with the following formula:

$$\text{set pressure}=\text{hydraulic head pressure}-\text{required flow rate}/R(n+1).$$

Figure 8:
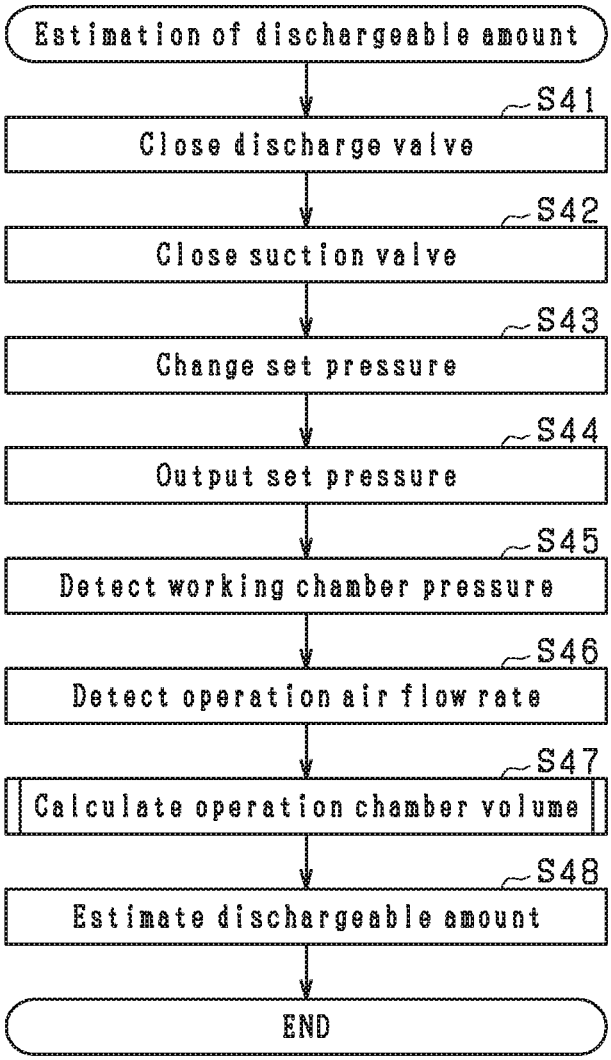
FIG. 8 is a flowchart showing a series of processes for estimating a dischargeable amount.

Estimation of Dischargeable Amount:

FIG. 8 is a flowchart showing a series of processes for estimating the dischargeable amount. The series of processes are executed by the controller 70.

The processes of S41 and S42 are the same as the processes of S11 and S12 of FIG. 4.

Subsequently, the controller 70 changes the set pressure for the working chamber 26 (S43). Specifically, the controller 70 changes the set pressure to a pressure at which a change in the flow rate of the operation air caused by a change in the pressure within the working chamber 26 can be accurately detected in a state in which the discharge valve 46 and the suction valve 40 are closed; namely, in a state in which the diaphragm 23 does not fluctuate. For example, the controller 70 raises the set pressure from the atmospheric pressure to a predetermined pressure.

The processes of S44 to S46 are the same as the processes of S15, S17, and S18 of FIG. 4.

Subsequently, the controller 70 calculates the volume of the operation chamber (S47). Specifically, the formula F5 of FIG. 6 is obtained by deforming the formula F4 of FIG. 6. Since the diaphragm 23 does not fluctuate, the detected flow rate QA(n+1) at that time can be considered to be equal to the pressure change corresponding flow rate QP(n+1). V represents an operation chamber volume which is the sum of the volume V(n) of the working chamber 26 at that time and the volume of the air supply pipe 50, QA(n+1) represents the detected flow rate at the present moment, P0 represents a reference pressure, ΔP(n+1) represents a pressure change (P(n+1)−P(n)), and Δt represents a predetermined sampling interval. Notably, the product of the detected flow rate QA(n+1) and the time Δt corresponds to the integrated flow rate.

Subsequently, the controller 70 estimates the dischargeable amount on the basis of the calculated operation chamber volume V (S48). Specifically, the controller 70 calculates the volume of the pump chamber 25 (i.e., the dischargeable amount) by subtracting the operation chamber volume V from the sum of the volume of the pump chamber 25 and the operation chamber volume V. The sum of the volume of the pump chamber 25 and the operation chamber volume V is a known value determined by the design of the pump 13. Notably, the dischargeable amount refers to the maximum volume of the resist solution R which can be discharged by the pump 13 at the present moment (i.e., in the present state). After that, the controller 70 ends the series of processes (END).

In the case where the dischargeable amount of the pump 13 at the present moment is smaller than a demanded amount (i.e., demanded volume) of the resist solution R which must be discharged, the pump 13 cannot discharge the demanded amount of the resist solution R by a discharge operation starting from the present state. Accordingly, in the case where the estimated dischargeable amount is less than the demanded amount of the resist solution R when the discharge of the resist solution R by the pump 13 is started, the controller 70 causes the pump 13 to suck the resist solution R by controlling the electro-pneumatic regulator 51 such that the pump 13 can discharge the demanded amount of the resist solution R. For example, the controller 70 causes the pump 13 to suck the resist solution R until the volume of the pump chamber 25; i.e., the dischargeable amount, becomes equal to the demanded amount, or the dischargeable amount becomes greater than the demanded amount.

Estimation of Bubble Volume and Dischargeable Amount:

In the case where bubbles are contained in the resist solution R within the pump chamber 25, even when the above-described "estimation of the dischargeable amount" is executed, there is a possibility that the maximum volume of the resist solution R which can be discharged at the present moment when the resist solution R is discharged cannot be accurately estimated.

Figure 10:
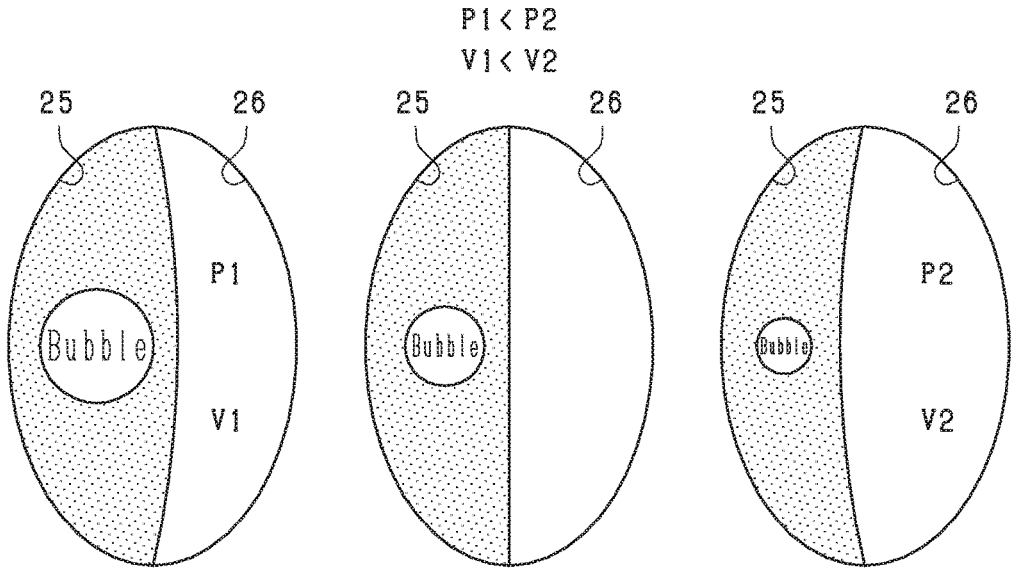
FIG. 10 is a diagram showing the relation between the volume of bubbles in resist solution and the pressure within the working chamber.

FIG. 10 shows a state in which the resist solution R contains bubbles and the volume of the bubbles changes with the pressure within the pump chamber 25; i.e., the pressure within the working chamber 26. As shown in FIG. 10, the higher the pressure within the working chamber 26, the smaller the volume of the bubbles within the resist solution R.

Figure 11:
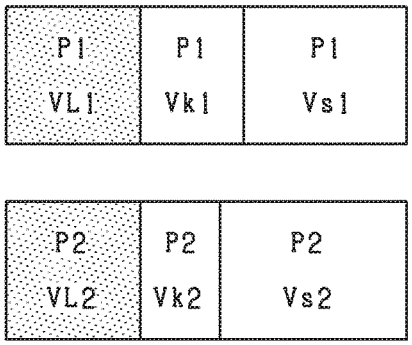
FIG. 11 is a diagram showing the relation between the volume of discharged liquid and the volume of the working chamber.

FIG. 11 shows, on its upper side, the relation among a discharged liquid volume VL1 which is the volume of the resist solution R, a bubble volume Vk1, and an operation chamber volume Vs1 which is the volume of the working chamber 26 at a pressure P1 (corresponding to the first pressure). Also, FIG. 11 shows, on its lower side, the relation among a discharged liquid volume VL2, a bubble volume Vk2, and an operation chamber volume Vs2 at a pressure P2 (corresponding to the second pressure).

Boyle's law holds for the operation air within the working chamber 26. Therefore, there holds the relation that the product of the pressure P1 and the operation chamber volume Vs1 is equal to the product of the pressure P2 and the operation chamber volume Vs2. Namely, P1·Vk1=P2·Vk2 holds. Also, there holds the relation that the difference between the volume Vk1 of the bubbles within the pump chamber 25 at the pressure P1 and the volume Vk2 of the bubbles within the pump chamber 25 at the pressure P2 is equal to the difference (the absolute value of the difference) between the operation chamber volume Vs1 at the pressure P1 and the operation chamber volume Vs2 at the pressure P2. Namely, Vk1−Vk2=Vs2−Vs1 holds. From these relations, a relational expression of Vk1={P2/(P2−P1)}·(Vs2−Vs1) can be derived. Accordingly, the volume Vk1 of the bubbles within the pump chamber 25 at the pressure P1 can be estimated on the basis of the pressure P1, the pressure P2, the operation chamber volume Vs1, and the operation chamber volume Vs2. Similarly, the volume Vk2 of the bubbles within the pump chamber 25 at the pressure P2 can be estimated on the basis of the pressure P1, the pressure P2, the operation chamber volume Vs1, and the operation chamber volume Vs2. Thus, the maximum volume of the resist solution R which can be discharged at the present moment when the resist solution R is discharged can be accurately estimated.

Figure 12:
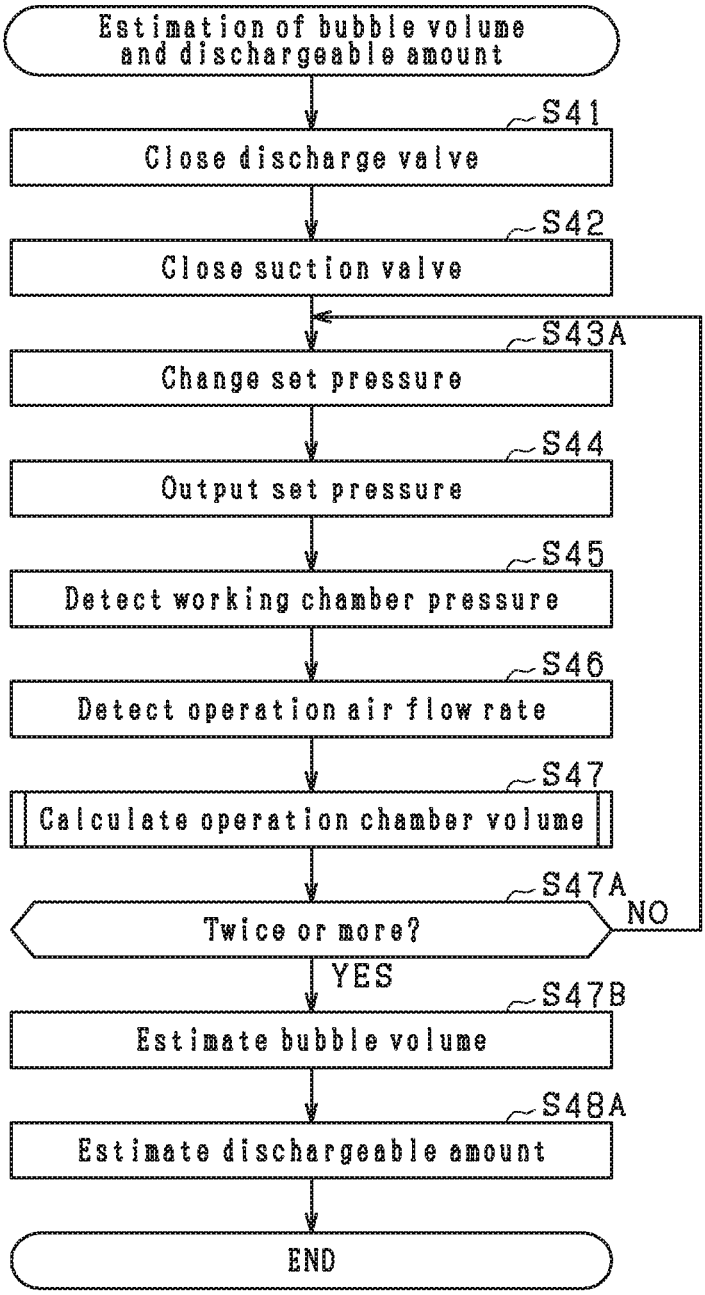
FIG. 12 is a flowchart showing a series of processes for estimating the volume of bubbles and the dischargeable amount.

FIG. 12 is a flowchart showing a series of processes for estimating the bubble volume and the dischargeable amount. The series of processes are executed by the controller 70. The same processes as those shown in FIG. 8 are denoted by the same step numbers as those used in FIG. 8 and their description will be omitted. Namely, FIG. 12 differs from FIG. 8 in the following points. In S43A, the controller 70 changes the set pressure to the pressure P1 for the first time and changes the set pressure to the pressure P2 for the second time. Subsequent to S47, the controller 70 determines whether or not the calculation of the operation chamber volume has been performed two or more times (whether or not the first current volume and the second current volume have been calculated) (S47A). In the case where the controller 70 determines that the calculation of the operation chamber volume has not yet been performed two or more times (S47A: NO), the controller 70 again executes the series of processes from the process of S43A. Meanwhile, in the case where the controller 70 determines that the calculation of the operation chamber volume has been performed two or more times (S47A: YES), the controller 70 calculates, for example, the bubble volume Vk2 on the basis of the above-described relational expression. Subsequently, the controller 70 subtracts the bubble volume Vk2 from the maximum volume of the dischargeable resist solution R calculated in the same manner as in S48 of FIG. 8, to thereby calculate the maximum volume of the dischargeable resist solution R, excluding the bubbles, at the pressure P2 (S48A). Accordingly, it is possible to accurately estimate the maximum volume of the resist solution R which can be actually discharged at the present moment (the maximum volume of the resist solution R as dischargeable liquid) when the resist solution R is discharged.

Estimation of Discharge-Side Hydraulic Head Pressure:

The controller 70 performs the same processes as those shown in FIG. 4 except that the controller 70 performs a process of opening the discharge valve 46 in place of the process of S16 and performs a process of closing the discharge valve 46 in place of the process of S19. Thus, the controller 70 estimates the hydraulic head pressure on the discharge side (the discharge valve side, the second valve side) in S24. Notably, this series of processes corresponds to the method of controlling the liquid supply system.

Estimation of Discharge-Side Relation Coefficient:

The controller 70 performs the same processes as those shown in FIG. 7 (S25 to S29, S31, S32, and S34 to S38 of FIG. 7) except that the controller 70 performs a process of opening the discharge valve 46 in place of the process of S30 and performs a process of closing the discharge valve 46 in place of the process of S33. Thus, the controller 70 estimates the relation coefficient on the discharge side (the discharge valve side, the second valve side) in S38.

In the chemical supply system 10, when the amount of the resist solution R present in the discharge pipe 47 on the downstream side of the pump chamber 25 changes, the discharge-side hydraulic head pressure of the resist solution R changes. Also, when the operation period of the chemical supply system 10 becomes long, the discharge-side pressure loss of the resist solution R changes, and the discharge-side relation coefficient changes accordingly. In the pump 13, the relation between the pressure within the space (i.e., the operation chamber) including the working chamber 26 and the air supply pipe 50 and the discharge amount of the resist solution R changes in accordance with the discharge-side hydraulic head pressure of the resist solution R and the discharge-side relation coefficient thereof.

In view of this, the controller 70 changes the set pressure for the time of discharge of the resist solution R on the basis of the estimated discharge-side hydraulic head pressure and the estimated discharge-side relation coefficient. The controller 70 then controls the electro-pneumatic regulator 51 such that the pressure detected by the pressure sensor 72 becomes equal to the set pressure. For example, the controller 70 raises the set pressure for the time of discharge of the resist solution R from the pump 13 as the discharge-side hydraulic head pressure of the resist solution R rises. The controller 70 raises the set pressure at the time of discharge of the resist solution R from the pump 13 as the discharge-side relation coefficient of the resist solution R becomes smaller. Specifically, the following relation of the required flow rate is satisfied:

$$\text{the required flow rate} = R(n+1) \times (\text{the set pressure} - \text{the hydraulic head pressure})$$

Therefore, the set pressure is changed in accordance with the following formula:

$$\text{set pressure} = \text{required flow rate}/R(n+1) + \text{hydraulic head pressure.}$$

The present embodiment having been described in detail has the following advantages.

The above-mentioned electro-pneumatic regulator 51, the above-mentioned suction valve 40, and the above-mentioned discharge valve 46 are controlled by the controller 70. Specifically, since the discharge valve 46 is closed and the suction valve 40 is opened by the controller 70, the resist solution R flows into the pump chamber 25 through the suction pipe 41. As a result, the diaphragm 23 is fluctuated by the resist solution R within the pump chamber 25, whereby the volume of the working chamber 26 is changed. At that time, the change in the volume of the working chamber 26 is calculated on the basis of the flow rate detected by the flow rate sensor 71.

Further, the electro-pneumatic regulator 51 is controlled by the controller 70 such that the change in the volume of the working chamber 26 becomes zero, and the operation air is supplied to and discharged from the working chamber 26 by the electro-pneumatic regulator 51. As a result, the change in the volume of the working chamber 26 is quickly decreased to zero. In the state in which the discharge valve 46 is closed, the suction valve 40 is opened, and the change in the volume of the working chamber 26 is zero, the pressure of the space including the working chamber 26 is equal to the suction-side hydraulic head pressure of the resist solution R. Therefore, the pressure detected by the pressure sensor 72 in the state in which the change in the volume of the working chamber 26 has become zero is used as an estimated suction-side hydraulic head pressure of the resist solution R. Accordingly, the hydraulic head pressure of the resist solution R can be estimated quickly.

The discharge valve 46 is closed and the suction valve 40 is opened by the controller 70, and the electro-pneumatic regulator 51 is controlled by the controller 70 to change the pressure within the space including the working chamber 26. As a result, with the change in the pressure within the space including the working chamber 26, the volume of the working chamber 26 changes, and thus the volume of the pump chamber 25 changes, whereby the resist solution R flows into the pump chamber 25 or flows out of the pump chamber 25. In the state in which the discharge valve 46 is closed and the suction valve 40 is opened, the amount of the change in the pressure within the space including the working chamber 26 and the amount of the change in the flow rate of the resist solution R have a predetermined relation therebetween which reflects the suction-side pressure loss of the resist solution R.

In view of this, the pressure change amount is calculated by the controller 70 on the basis of the pressure detected by the pressure sensor 72, and the flow rate change amount is calculated by the controller 70 on the basis of the flow rate detected by the flow rate sensor 71. The flow rate of the operation air detected by the flow rate sensor 71 correlates with the flow rate of the resist solution R which flows into the pump chamber 25 and flows out of the pump chamber 25. Accordingly, the suction-side relation coefficient which represents the relation between the pressure within the space including the working chamber 26 and the flow rate of the resist solution R can be estimated on the basis of the amount of the change in the pressure within the space including the working chamber 26 and the amount of the change in the flow rate of the operation air which flows into and flows out of the working chamber 26.

The target pressure (specifically, the set pressure) within the space including the working chamber 26 when the resist solution R is sucked is set by the controller 70 on the basis of the estimated suction-side hydraulic head pressure and the estimated suction-side relation coefficient. The electro-pneumatic regulator 51 is then controlled by the controller 70 such that the pressure detected by the pressure sensor 72 coincides with the target pressure. Accordingly, even when the suction-side hydraulic head pressure of the resist solution R and the suction-side relation coefficient change, the suction amount of the resist solution R can be controlled accurately.

Deterioration of the filter 41*a* is reported by the controller 70 on the basis of the estimated suction-side relation coefficient. Therefore, it is possible to prompt a user to exchange the filter 41*a* at a proper timing.

Since the suction valve 40 is closed and the discharge valve 46 is opened by the controller 70, the resist solution R flows out of the pump chamber 25 into the discharge pipe 47. As a result, the diaphragm 23 is fluctuated by the resist solution R within the pump chamber 25, whereby the volume of the working chamber 26 is changed. At that time, the change in the volume of the working chamber 26 is calculated on the basis of the flow rate detected by the flow rate sensor 71.

Further, the electro-pneumatic regulator 51 is controlled by the controller 70 such that the change in the volume of the working chamber 26 becomes zero, and the operation air is supplied to and discharged from the working chamber 26 by the electro-pneumatic regulator 51. As a result, the change in the volume of the working chamber 26 is quickly decreased to zero. In the state in which the suction valve 40 is closed, the discharge valve 46 is opened, and the change in the volume of the working chamber 26 is zero, the pressure of the space including the working chamber 26 is equal to the discharge-side hydraulic head pressure of the resist solution R. Therefore, the pressure detected by the pressure sensor 72 in the state in which the change in the volume of the working chamber 26 has become zero is used as an estimated discharge-side hydraulic head pressure of the resist solution R. Accordingly, the hydraulic head pressure of the resist solution R can be estimated quickly.

The suction valve 40 is closed and the discharge valve 46 is opened by the controller 70, and the electro-pneumatic regulator 51 is controlled by the controller 70 to change the pressure within the space including the working chamber 26. As a result, with the change in the pressure within the space including the working chamber 26, the volume of the working chamber 26 changes, and thus the volume of the pump chamber 25 changes, whereby the resist solution R flows into the pump chamber 25 or flows out of the pump chamber 25. In the state in which the suction valve 40 is closed and the discharge valve 46 is opened, the amount of the change in the pressure within the space including the working chamber 26 and the amount of the change in the flow rate of the resist solution R have a predetermined relation therebetween which reflects the discharge-side pressure loss of the resist solution R.

In view of this, the pressure change amount is calculated by the controller 70 on the basis of the pressure detected by the pressure sensor 72, and the flow rate change amount is calculated by the controller 70 on the basis of the flow rate detected by the flow rate sensor 71. The flow rate of the operation air detected by the flow rate sensor 71 correlates with the flow rate of the resist solution R which flows into the pump chamber 25 and flows out of the pump chamber 25. Accordingly, the discharge-side relation coefficient which represents the relation between the pressure within the space including the working chamber 26 and the flow rate of the resist solution R can be estimated on the basis of the amount of the change in the pressure within the space including the working chamber 26 and the amount of the change in the flow rate of the operation air which flows into the working chamber 26.

The target pressure within the space including the working chamber 26 when the resist solution R is discharged is set by the controller 70 on the basis of the estimated discharge-side hydraulic head pressure and the estimated discharge-side relation coefficient. The electro-pneumatic regulator 51 is then controlled by the controller 70 such that the pressure detected by the pressure sensor 72 coincides with the target pressure. Accordingly, even when the discharge-side hydraulic head pressure of the resist solution R and the discharge-side relation coefficient change, the discharge amount of the resist solution R can be controlled accurately.

When the electro-pneumatic regulator 51 is controlled such that the change in the volume becomes zero, the electro-pneumatic regulator 51 is controlled so as to raise the pressure within the working chamber 26 in the case where the volume of the working chamber 26 has decreased. Also, the electro-pneumatic regulator 51 is controlled so as to lower the pressure within the working chamber 26 in the case where the volume of the working chamber 26 has increased. Therefore, the electro-pneumatic regulator 51 can be controlled in accordance with the trend of the change in the volume of the working chamber 26, whereby the change in the volume can be decreased to zero quickly.

When the electro-pneumatic regulator 51 is controlled such that the change in the volume becomes zero, the electro-pneumatic regulator 51 is controlled such that the greater the rate at which the volume of the working chamber 26 decreases, the greater the degree to which the pressure within the working chamber 26 is raised. Also, the electro-pneumatic regulator 51 is controlled such that the greater the rate at which the volume of the working chamber 26 increases, the greater the degree to which the pressure within the working chamber 26 is lowered. Therefore, the electro-pneumatic regulator 51 can be controlled in accordance with the trend of the change in the volume of the working chamber 26 and the changing speed, whereby the change in the volume can be decreased to zero more quickly.

The discharge valve 46 and the suction valve 40 are closed by the controller 70, and the electro-pneumatic regulator 51 is controlled by the controller 70 to change the pressure within the space including the working chamber 26. As a result, the operation air flows into or flows out of the space including the working chamber 26. The operation air flowing into or flowing out of the space including the working chamber 26 contributes to the change in the pressure within the space including the working chamber 26 in a state in which the discharge valve 46 and the suction valve 40 are closed. The amount of the change in the pressure within the space including the working chamber 26 caused by the operation air flowing into or flowing out of the working chamber 26 changes with the volume of the space including the working chamber 26 at the present moment. Therefore, the relation between the amount of the change in the pressure within the space including the working chamber 26 and the integrated flow rate of the operation air (i.e., the amount of the operation air flowing into or flowing out of the space) reflects the current volume of the working chamber 26. Accordingly, the current volume of the space including the working chamber 26 can be calculated on the basis of the amount of the change in the pressure within the space including the working chamber 26 and the integrated flow rate of the operation air flowing into the working chamber 26.

In the pump, the sum of the volume of the pump chamber 25 and the volume of the space including the working chamber 26 is constant. The amount of the resist solution R which the pump can discharge by a single discharge operation is determined by the volume of the resist solution R sucked into the pump chamber 25 at the present moment; namely, by the current volume of the pump chamber 25. Therefore, the maximum volume of the resist solution R which can be discharged at the present moment when the resist solution R is discharged (i.e., the dischargeable amount) can be estimated on the basis of the current volume of the space including the working chamber 26.

In the case where, when the discharge of the resist solution R by the pump is started, the estimated maximum volume is smaller than the demanded volume of the resist solution R to be discharged, the electro-pneumatic regulator 51 is controlled by the controller 70 so as to cause the pump to suck the resist solution R, so that the pump can discharge the demanded volume of the resist solution R. Accordingly, in the case where the volume of the resist solution R sucked in the pump chamber 25 at the present moment is smaller than the demanded volume, the demanded volume of the resist solution R can be discharged after replenishing the pump chamber 25 with the resist solution R.

The hydraulic head pressure is estimated by the controller 70 under the condition that the electro-pneumatic regulator 51 has been controlled so as to fluctuate the diaphragm 23 to a position where a tension generated in the diaphragm 23 becomes smaller than the predetermined value. Therefore, the hydraulic head pressure can be estimated accurately by reducing the influence of the tension generated in the diaphragm 23.

Notably, the above-described embodiment may be modified as follows.

The process of reporting the deterioration of the filter 41*a* may be omitted.

The pressure sensor 72 may be a pressure sensor for detecting the pressure within the working chamber 26.

Figure 9:
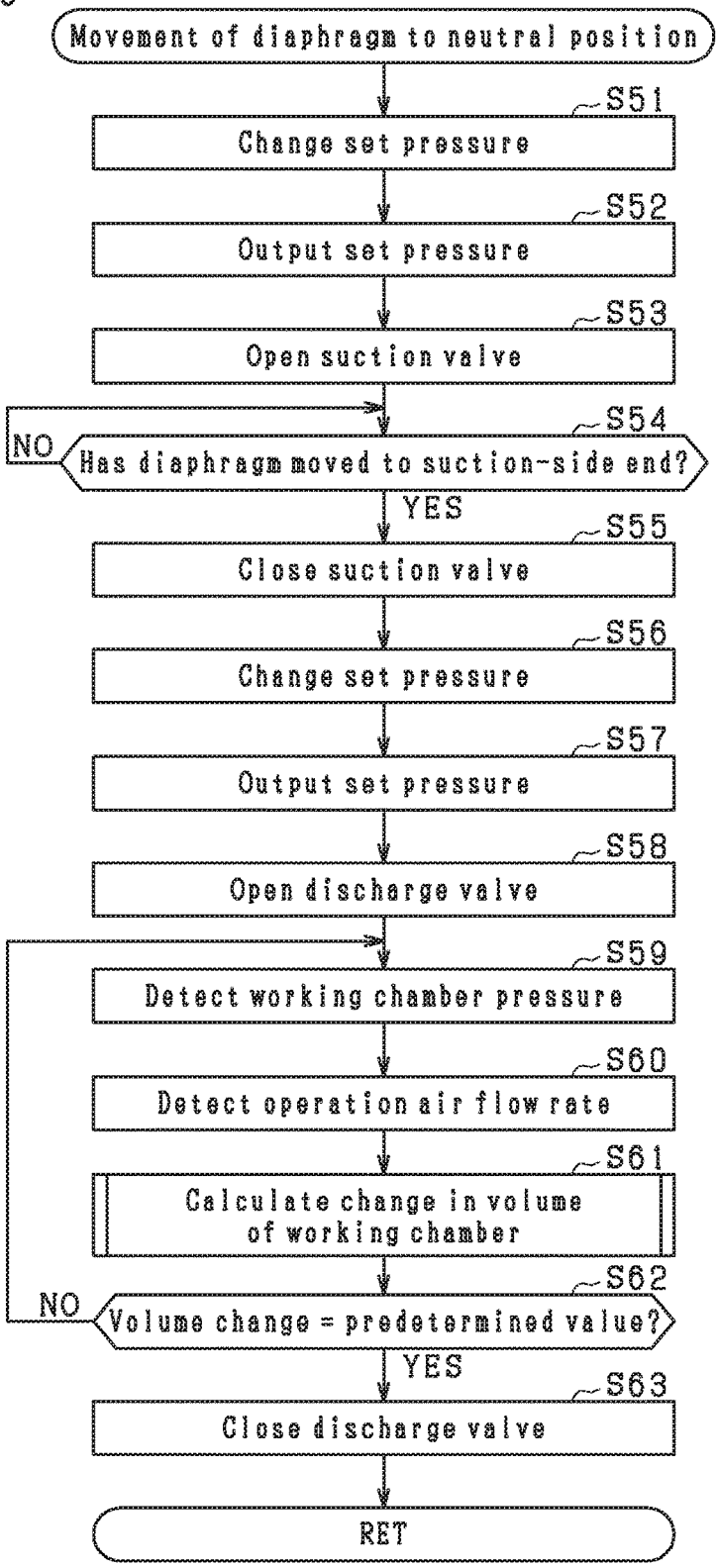
FIG. 9 is a flowchart showing a modification of the series of processes for moving the diaphragm to the neutral position.

FIG. 9 is a flowchart showing a modification of the processes of moving the diaphragm 23 to the neutral position. This series of processes are executed by the controller 70.

First, the controller 70 changes the set pressure for the working chamber 26 (S51). Specifically, the controller 70 changes the set pressure to a predetermined pressure at which the diaphragm 23 can be moved from the pump chamber 25 side to the end on the working chamber 26 side (i.e., the suction-side end). Subsequently, the controller 70 outputs the changed set pressure to the electro-pneumatic regulator 51 (S52). As a result, the electro-pneumatic regulator 51 controls the pressure within the working chamber 26 to the set pressure.

Subsequently, the controller 70 opens the suction valve 40 (S53). Notably, the discharge valve 46 has been closed by the process of S11 of FIG. 4.

Subsequently, the controller 70 determines whether or not the diaphragm 23 has moved to the suction-side end (S54). Specifically, the controller 70 determines that the diaphragm 23 has moved to the suction-side end when the change in the volume of the working chamber 26 has become zero after the start of the suction operation of the pump 13. Notably, the controller 70 may determine that the diaphragm 23 has moved to the suction-side end when the flow rate of the operation air has become zero after the start of the suction operation or when a predetermined period of time has elapsed after the start of the suction operation. In the case where the controller 70 determines that the diaphragm 23 has not yet moved to the suction-side end (S54: NO), the controller 70 waits by repeating the determination of S54.

Meanwhile, in the case where the controller 70 determines in S54 that the diaphragm 23 has moved to the suction-side end (S54: YES), the controller 70 closes the suction valve 40 (S55).

Subsequently, the controller 70 changes the set pressure for the working chamber 26 (S56). Specifically, the controller 70 changes the set pressure to a predetermined pressure at which the diaphragm 23 can be moved to the neutral position with a proper speed. This predetermined pressure is set such that the diaphragm 23 can be fluctuated to the neutral position without fail and the diaphragm 23 does not fluctuate greatly to the pump chamber 25 side with respect to the neutral position. Subsequently, the controller 70 outputs the changed set pressure to the electro-pneumatic regulator 51 (S57). As a result, the electro-pneumatic regulator 51 controls the pressure within the working chamber 26 to the set pressure.

Subsequently, the controller 70 opens the discharge valve 46 (S58).

The processes of S59 to S61 are basically the same as those of S17, S18, and S20 of FIG. 4. However, in the process of S61, the controller 70 calculates the change in the volume of the working chamber 26 from the state in which the diaphragm 23 has moved to the suction-side end.

Subsequently, the controller 70 determines whether or not the change in the volume of the working chamber 26 has become a predetermined amount (S62). This predetermined amount is set to an amount (known amount) by which the volume of the working chamber 26 changes until the diaphragm 23 moves to the neutral position from the state in which the diaphragm 23 has moved to the suction-side end. In the case where the controller 70 determines that the change in the volume of the working chamber 26 has not yet become the predetermined amount (S62: NO), the controller 70 again executes the series of processes from the process of S59.

Meanwhile, in the case where the controller 70 determines in S62 that the change in the volume of the working chamber 26 has become the predetermined amount (S62: YES), the controller 70 closes the discharge valve 46 (S63). As a result, the diaphragm 23 stops at the neutral position. After that, the controller 70 returns to the process of S13 and subsequent processes of FIG. 4 (RET).

In the flowchart of FIG. 4, the processes of S13 and S22 for moving the diaphragm 23 to the neutral position may be omitted. In the case where the influence of the tension generated in the diaphragm 23 is small (for example, in the case where the diameter of the diaphragm 23 is sufficiently large as compared with the fluctuation amount (i.e., stroke) of the diaphragm 23), no problem occurs even when the processes of S13 and S22 are omitted.

In FIG. 6, when the change Qv(n+1) in the volume of the working chamber 26 per unit time is calculated, the pressure change corresponding flow rate QP(n+1) is taken into consideration. However, for simplification, the volume change Qv(n+1) may be calculated with the pressure change corresponding flow rate QP(n+1) regarded as zero. In such a case, the flow rate QM(n+1) at the reference pressure P0 can be considered to be equal to the detected flow rate QA(n+1).

In the above-described embodiment, in the case where the estimated dischargeable amount is smaller than the demanded amount of the resist solution R, the pump 13 is caused to suck the resist solution R such that the pump 13 can discharge the demanded amount of the resist solution R. However, it is sufficient that, in the case where the estimated dischargeable amount is smaller than the demanded amount of the resist solution R, the pump 13 is caused to suck the resist solution R to thereby increase the dischargeable amount. Also, these processes for causing the pump 13 to suck the resist solution R may be omitted.

The process for estimating the dischargeable amount may be omitted.

In the above-described embodiment, the controller 70 changes the set pressure for suction of the resist solution R on the basis of the estimated suction-side hydraulic head pressure and the estimated suction-side relation coefficient. However, the set pressure at the time of suction of the resist solution R may be changed on the basis of one of the estimated suction-side hydraulic head pressure and the estimated suction-side relation coefficient. Also, the set pressure at the time of discharge of the resist solution R may be changed on the basis of one of the estimated discharge-side hydraulic head pressure and the estimated discharge-side relation coefficient.

In the flowchart of FIG. 4, the processes of S12 and S19 for closing the suction valve 40 and the processes of S13 and S22 for moving the diaphragm 23 to the neutral position may be omitted, and the process of S14 and processes subsequent thereto may be executed in the state in which the suction valve 40 is opened.

In the above-described embodiment, the controller 70 executes the processes for estimating the hydraulic head pressure, moving the diaphragm 23 to the neutral position, estimating the relation coefficient, and estimating the dischargeable amount. However, these processes may be executed by a controller (i.e., a control section) which is higher in level than the controller 70.

In the above-described embodiment, operation air is used as the working gas supplied to and discharged from the working chamber 26. However, a gas other than air, such as nitrogen, may be used as the working gas.

In the above-described embodiment, the diaphragm pump 13 is employed. However, for example, a bellows pump may be employed. In general, there can be employed a pump in which a fluctuating member (a deformable member or a movable member such as a piston) which separates the pump and working chambers thereof is driven by supply of a working gas.

The above-described embodiment, the resist solution R, which is liquid, is applied to the semiconductor wafer W. However, the type of chemical and the types of process are not limited thereto, and the present invention can be applied to other liquid supply systems which supply liquid.

The embodiments and modification thereof in this application includes the above-described first aspect and the following aspects.

In a second aspect, when the control section is configured to close the discharge valve and open the suction valve and change the pressure within the space including the working chamber by controlling the supply and discharge section, the control section is being configured to calculate a pressure change amount on the basis of the pressure detected by the pressure sensor and a flow rate change amount on the basis of the flow rate detected by the flow rate sensor, and estimate a suction-side relation coefficient which represents a relation between the pressure within the space including the working chamber and the flow rate of the liquid on the basis of the pressure change amount and the flow rate change amount.

According to the above-described configuration, the discharge valve is closed and the suction valve is opened by the control section, and the supply and discharge section is controlled by the control section to change the pressure within the space including the working chamber. As a result, with the change in the pressure within the space including the working chamber, the volume of the working chamber changes, and thus the volume of the pump chamber changes, whereby the liquid flows into the pump chamber or flows out of the pump chamber. In the state in which the discharge valve is closed and the suction valve is opened, the amount of the change in the pressure within the space including the working chamber and the amount of the change in the flow rate of the liquid have a predetermined relation therebetween which reflects the suction-side pressure loss of the liquid.

In view of this, the pressure change amount is calculated by the control section on the basis of the pressure detected by the pressure sensor, and the flow rate change amount is calculated by the control section on the basis of the flow rate detected by the flow rate sensor. The flow rate of the working gas detected by the flow rate sensor correlates with the flow rate of the liquid which flows into the pump chamber and flows out of the pump chamber. For example, the flow rate of the working gas flowing into the working chamber can be considered to be equal to the flow rate of the liquid which flows out of the pump chamber. Accordingly, the suction-side relation coefficient which represents the relation between the pressure within the space including the working chamber and the flow rate of the liquid can be estimated on the basis of the amount of the change in the pressure within the space including the working chamber and the amount of the change in the flow rate of the working gas which flows into and flows out of the working chamber.

In a third aspect, the control section is configured to set, on the basis of the estimated suction-side hydraulic head pressure and the estimated suction-side relation coefficient, a target pressure within the space including the working chamber when the liquid is sucked, and control the supply and discharge section such that the pressure detected by the pressure sensor coincides with the target pressure.

When the amount of the liquid within the liquid container changes as a result of use of the liquid, the suction-side hydraulic head pressure of the liquid changes. Also, when the operation period of the liquid supply system becomes long, the suction-side pressure loss of the liquid changes, and the suction-side relation coefficient changes accordingly. In the pump, the relation between the pressure within the space including the working chamber and the suction amount of the liquid changes in accordance with the suction-side hydraulic head pressure of the liquid and the suction-side relation coefficient.

According to the above-described configuration, the target pressure within the space including the working chamber when the liquid is sucked is set by the control section on the basis of the estimated suction-side hydraulic head pressure and the estimated suction-side relation coefficient. The supply and discharge section is controlled by the control section such that the pressure detected by the pressure sensor coincides with the target pressure. Accordingly, even when the suction-side hydraulic head pressure of the liquid and the suction-side relation coefficient change, the suction amount of the liquid can be controlled accurately.

In a fourth aspect, a filter for the liquid is provided in the inflow passage, and the control section is configured to report deterioration of the filter on the basis of the estimated suction-side relation coefficient.

In the case where a filter for the liquid is provided in the inflow passage, the suction-side pressure loss and thus the relation coefficient changes with the degree of deterioration of the filter. In view of this, the control section reports the deterioration of the filter on the basis of the estimated suction-side relation coefficient. Therefore, it is possible to prompt a user to exchange the filter at a proper timing.

In a fifth aspect, the control section is configured to close the suction valve and open the discharge valve, calculate a change in the volume of the working chamber on the basis of the flow rate detected by the flow rate sensor, control the supply and discharge section such that the change in the volume becomes zero, and use, as an estimated discharge-side hydraulic head pressure of the liquid, the pressure detected by the pressure sensor in a state in which the change in the volume has become zero.

A sixth aspect is a liquid supply system comprising a pump, a supply and discharge section, a suction valve, a discharge valve, a pressure sensor, a flow rate sensor, and a control section as described below:

The pump includes a pump chamber into which a liquid supplied from a liquid container flows and from which the liquid flows out, a working chamber into which a working gas is supplied and from which the working gas is discharged, and a fluctuating member which separates the pump chamber and the working chamber from each other, the pump is being configured to suck and discharge the liquid in accordance with change in a volume of the pump chamber caused by fluctuation of the fluctuating member.

The supply and discharge section is configured to which supply the working gas to the working chamber and discharge the working gas from the working chamber.

The suction valve is configured to open and close an inflow passage through which the liquid flows into the pump chamber, and the discharge valve is configured to open and close a discharge passage through which the liquid flows out of the pump chamber.

The pressure sensor is configured to detect pressure within a space including the working chamber, and the flow rate sensor is configured to detect flow rate of the working gas supplied to the working chamber.

The control is section configured to control the supply and discharge section, the suction valve, and the discharge valve, wherein the control section is further configured to close the suction valve and open the discharge valve, calculate a change in a volume of the working chamber on the basis of the flow rate detected by the flow rate sensor, control the supply and discharge section such that the change in the volume becomes zero, and use, as an estimated discharge-side hydraulic head pressure of the liquid, the pressure detected by the pressure sensor in a state in which the change in the volume has become zero.

According to the above-described configuration, since the suction valve is closed and the discharge valve is opened by the control section, the liquid flows out of the pump chamber to the outflow passage. The fluctuating member is fluctuated by the liquid within the pump chamber, whereby the volume of the working chamber is changed. At that time, the change in the volume of the working chamber is calculated on the basis of the flow rate detected by the flow rate sensor.

Further, the supply and discharge section is controlled by the control section such that the change in the volume becomes zero, and the working gas is supplied to and discharged from the working chamber by the supply and discharge section. As a result, the change in the volume of the working chamber is quickly decreased to zero. In a state in which the suction valve is closed, the discharge valve is opened, and the change in the volume of the working chamber has become zero, the pressure within the space including the working chamber is equal to the discharge-side hydraulic head pressure of the liquid. Therefore, the pressure detected by the pressure sensor in the state in which the change in the volume of the working chamber has become zero is used as an estimated discharge-side hydraulic head pressure of the liquid. Accordingly, the hydraulic head pressure of the liquid can be estimated quickly.

A broader aspect which encompasses the first and sixth aspects is a liquid supply system comprising a pump, a supply and discharge section, a section valve, a discharge valve, a pressure sensor, a flow rate sensor, and a control section, as described below:

The pump includes a pump chamber into which a liquid supplied from a liquid container flows and from which the liquid flows out, a working chamber into which a working gas is supplied and from which the working gas is discharged, and a fluctuating member which separates the pump chamber and the working chamber from each other, the pump is being configured to suck and discharge the liquid in accordance with change in a volume of the pump chamber caused by fluctuation of the fluctuating member.

The supply and discharge section is configured to supply the working gas to the working chamber and discharge the working gas from the working chamber.

The suction valve is configured to open and close an inflow passage through which the liquid flows into the pump chamber, and the discharge valve is configured to open and close a discharge passage through which the liquid flows out of the pump chamber.

The pressure sensor is configured to detect pressure within a space including the working chamber, and the flow rate sensor is configured to detect flow rate of the working gas which flows into and flows out of the working chamber.

The control section is configured to control the supply and discharge section, the suction valve, and the discharge valve, wherein the control section is further configured to close a first valve which is one of the suction valve and the discharge valve and open a second valve which is the other of the suction valve and the discharge valve, calculate a change in a volume of the working chamber on the basis of the flow rate detected by the flow rate sensor, control the supply and discharge section such that the change in the volume becomes zero, and use, as an estimated hydraulic head pressure of the liquid on the second valve side, the pressure detected by the pressure sensor in a state in which the change in the volume has become zero.

In a seventh aspect, when the control section is configured to close the suction valve and open the discharge valve and change the pressure within the space including the working chamber by controlling the supply and discharge section, the control section is being configured to calculate a pressure change amount on the basis of the pressure detected by the pressure sensor and a flow rate change amount on the basis of the flow rate detected by the flow rate sensor, and estimate a discharge-side relation coefficient which represents a relation between the pressure within the space including the working chamber and the flow rate of the liquid on the basis of the pressure change amount and the flow rate change amount.

According to the above-described configuration, the suction valve is closed and the discharge valve is opened by the control section, and the supply and discharge section is controlled by the control section to change the pressure within the space including the working chamber. As a result, with the change in the pressure within the space including the working chamber, the volume of the working chamber changes, and thus the volume of the pump chamber changes, whereby the liquid flows into the pump chamber or flows out of the pump chamber. In the state in which the suction valve is closed and the discharge valve is opened, the amount of the change in the pressure within the space including the working chamber and the amount of the change in the flow rate of the liquid have a predetermined relation therebetween which reflects the discharge-side pressure loss of the liquid.

In view of this, the pressure change amount is calculated by the control section on the basis of the pressure detected by the pressure sensor, and the flow rate change amount is calculated by the control section on the basis of the flow rate detected by the flow rate sensor. The flow rate of the working gas detected by the flow rate sensor correlates with the flow rate of the liquid which flows into the pump chamber and flows out of the pump chamber. Accordingly, the discharge-side relation coefficient which represents the relation between the pressure within the space including the working chamber and the flow rate of the liquid can be estimated on the basis of the amount of the change in the pressure within the space including the working chamber and the amount of the change in the flow rate of the working gas which flows into and flows out of the working chamber.

In an eighth aspect, the control section is configured to set, on the basis of the estimated discharge-side hydraulic head pressure and the estimated discharge-side relation coefficient, a target pressure within the space including the working chamber when the liquid is discharged, and control the supply and discharge section such that the pressure detected by the pressure sensor coincides with the target pressure.

When the amount of the liquid present in a flow passage on the downstream side of the pump chamber changes, the discharge-side hydraulic head pressure of the liquid changes. Also, when the operation period of the liquid supply system becomes long, the discharge-side pressure loss of the liquid changes, and the discharge-side relation coefficient changes accordingly. In the pump, the relation between the pressure within the space including the working chamber and the discharge amount of the liquid changes in accordance with the discharge-side hydraulic head pressure of the liquid and the discharge-side relation coefficient.

According to the above-described configuration, the target pressure within the space including the working chamber when the liquid is discharged is set by the control section on the basis of the estimated discharge-side hydraulic head pressure and the estimated discharge-side relation coefficient. The supply and discharge section is controlled by the control section such that the pressure detected by the pressure sensor coincides with the target pressure. Accordingly, even when the discharge-side hydraulic head pressure of the liquid and the discharge-side relation coefficient change, the discharge amount of the liquid can be controlled accurately.

In a ninth aspect, when the control section controls the supply and discharge section such that the change in the volume becomes zero, the control section controls the supply and discharge section so as to raise the pressure within the working chamber in the case where the volume of the working chamber has decreased and controls the supply and discharge section so as to lower the pressure within the working chamber in the case where the volume of the working chamber has increased.

According to the above-described configuration, when the supply and discharge section is controlled such that the change in the volume becomes zero, the supply and discharge section is controlled so as to raise the pressure within the working chamber in the case where the volume of the working chamber has decreased. Also, the supply and discharge section is controlled so as to lower the pressure within the working chamber in the case where the volume of the working chamber has increased. Therefore, the supply and discharge section can be controlled in accordance with the trend of the change in the volume of the working chamber, whereby the change in the volume can be decreased to zero quickly.

In a tenth aspect, when the control section controls the supply and discharge section such that the change in the volume becomes zero, the control section controls the supply and discharge section such that the greater the rate at which the volume of the working chamber decreases, the greater the degree to which the pressure within the working chamber is raised and such that the greater the rate at which the volume of the working chamber increases, the greater the degree to which the pressure within the working chamber is lowered.

According to the above-described configuration, when the supply and discharge section is controlled such that the change in the volume becomes zero, the supply and discharge section is controlled such that the greater the rate at which the volume of the working chamber decreases, the greater the degree to which the pressure within the working chamber is raised. Also, the supply and discharge section is controlled such that the greater the rate at which the volume of the working chamber increases, the greater the degree to which the pressure within the working chamber is lowered. Therefore, the supply and discharge section can be controlled in accordance with the trend of the change in the volume of the working chamber and the changing speed, whereby the change in the volume can be decreased to zero more quickly.

In an eleventh aspect, when the control section closes the discharge valve and the suction valve and changes the pressure within the space including the working chamber by controlling the supply and discharge section, the control section calculates a pressure change amount on the basis of the pressure detected by the pressure sensor and an integrated flow rate on the basis of the flow rate detected by the flow rate sensor, calculates a current volume of the space including the working chamber on the basis of the pressure change amount and the integrated flow rate, and estimates, on the basis of the current volume, a maximum volume of the liquid which can be discharged at the present moment when the liquid is discharged.

According to the above-described configuration, the discharge valve and the suction valve are closed by the control section, and the supply and discharge section is controlled by the control section to change the pressure within the space including the working chamber. As a result, the working gas flows into or flows out of the space including the working chamber. The working gas flowing into or flowing out of the space including the working chamber contributes the change in the pressure within the space including the working chamber in a state in which the discharge valve and the suction valve are closed. The amount of the change in the pressure within the space including the working chamber caused by the working gas flowing into or flowing out of the working chamber changes with the volume of the space including the working chamber at the present moment. Therefore, the relation between the amount of the change in the pressure within the space including the working chamber and the integrated flow rate of the working gas (i.e., the amount of the working gas flowing into or flowing out of the working chamber) reflects the current volume of the working chamber. Accordingly, the current volume of the space including the working chamber can be calculated on the basis of the amount of the change in the pressure within the space including the working chamber and the integrated flow rate of the working gas flowing into the working chamber.

Also, in the pump, the sum of the volume of the pump chamber and the volume of the space including the working chamber is constant. The maximum amount of the liquid which the pump can discharge by a single discharge operation is determined by the volume of the liquid sucked into the pump chamber at the present moment; namely, by the current volume of the pump chamber. Therefore, the maximum volume of the liquid which can be discharged at the present moment when the liquid is discharged can be estimated on the basis of the current volume of the space including the working chamber.

In a twelfth aspect, in the case where, when the discharge of the liquid by the pump is started, the estimated maximum volume is smaller than a demanded volume of the liquid to be discharged, the control section controls the supply and discharge section to cause the pump to suck the liquid so that the pump can discharge the demanded volume of the liquid.

In the case where the maximum volume of the liquid which the pump can discharge at the present moment is smaller than the demanded volume of the liquid to be discharged, the pump cannot discharge the demanded volume of the liquid by a discharge operation starting from the current state. In view of this, in the case where, when the discharge of the liquid by the pump is started, the estimated maximum volume is smaller than the demanded volume of the liquid to be discharged, the supply and discharge section is controlled by the control section so as to cause the pump to suck the liquid, so that the pump can discharge the demanded volume of the liquid. Accordingly, in the case where the volume of the liquid sucked in the pump chamber at the present moment is smaller than the demanded volume, the demanded volume of the liquid can be discharged after replenishing the pump chamber with the liquid.

In a thirteenth aspect, the control section estimates the hydraulic head pressure under a condition that the control section has controlled the supply and discharge section so as to fluctuate the fluctuating member to a position where a tension generated in the fluctuating member becomes smaller than a predetermined value.

In the case where the amount of fluctuation of the fluctuating member is large, the influence of the tension generated in the fluctuating member is large. In the case where the tension generated in the fluctuating member is large, there is a possibility that, due to the influence of the tension, the hydraulic head pressure of the liquid cannot be accurately estimated.

In view of this, according to the above-described configuration, the hydraulic head pressure is estimated under the condition that the supply and discharge section has been controlled by the control section such that the fluctuating member has been fluctuated to a position where the tension generated in the fluctuating member becomes smaller than the predetermined value. Therefore, the hydraulic head pressure can be accurately estimated by reducing the influence of the tension generated in the fluctuating member.

In the case where the liquid within the pump chamber contains bubbles, even when the eleventh aspect is used, there is a possibility that the maximum volume of the liquid which can be discharged at the present moment when the liquid is discharged cannot be accurately estimated.

In view of this, the control section may be configured to operate as follows. Specifically, when the control section closes the discharge valve and the suction valve and changes the pressure within the space including the working chamber to a first pressure by controlling the supply and discharge section, the control section calculates a pressure change amount on the basis of the pressure detected by the pressure sensor and an integrated flow rate on the basis of the flow rate detected by the flow rate sensor, and calculates a first current volume of the space including the working chamber on the basis of the pressure change amount and the integrated flow rate. Also, when the control section closes the discharge valve and the suction valve and changes the pressure within the space including the working chamber to a second pressure by controlling the supply and discharge section, the control section calculates a pressure change amount on the basis of the pressure detected by the pressure sensor and an integrated flow rate on the basis of the flow rate detected by the flow rate sensor, and calculates a second current volume of the space including the working chamber on the basis of the pressure change amount and the integrated flow rate. Subsequently, the control section estimates the volume of the bubbles within the pump chamber at the first pressure or the volume of the bubbles within the pump chamber at the second pressure on the basis of the first pressure, the second pressure, the first current volume, and the second current volume.

According to the above-described configuration, the calculation of the current volume in the eleventh aspect is executed at each of the first pressure and the second pressure. Boyle's law holds for the working gas within the working chamber. Therefore, there holds the relation that the product of the first pressure and the first current volume is equal to the product of the second pressure and the second current volume. Also, there holds the relation that the difference between the volume of the bubbles within the pump chamber at the first pressure and the volume of the bubbles within the pump chamber at the second pressure is equal to the difference between the first current volume and the second current volume. Accordingly, through use of these relations, the volume of the bubbles within the pump chamber at the first pressure or the volume of the bubbles within the pump chamber at the second pressure can be estimated on the basis of the first pressure, the second pressure, the first current volume, and the second current volume. Thus, the maximum volume of the liquid which can be discharged at the present moment when the liquid is discharged can be accurately estimated.

A fourteenth aspect is a method for controlling a liquid supply system which comprises a pump, a supply and discharge section, a section valve, a discharge valve, a pressure sensor, a flow rate sensor, and a control section, as described below:

The pump includes a pump chamber into which a liquid supplied from a liquid container flows and from which the liquid flows out, a working chamber into which a working gas is supplied and from which the working gas is discharged, and a fluctuating member which separates the pump chamber and the working chamber from each other. The pump is configured to suck and discharge the liquid in accordance with change in a volume of the pump chamber caused by fluctuation of the fluctuating member. The supply and discharge section is configured to supply the working gas to the working chamber and discharge the working gas from the working chamber. The suction valve is configured to open and close an inflow passage through which the liquid flows into the pump chamber; a discharge valve configured to open and close a discharge passage through which the liquid flows out of the pump chamber. The pressure sensor is configured to detect pressure within a space including the working chamber. The flow rate sensor is configured to detect flow rate of the working gas supplied to the working chamber. The method comprises the steps of closing the discharge valve and opening the suction valve, calculating a change in a volume of the working chamber on the basis of the flow rate detected by the flow rate sensor, controlling the supply and discharge section such that the calculated change in the volume becomes zero, and using, as an estimated suction-side hydraulic head pressure of the liquid, the pressure detected by the pressure sensor in a state in which the change in the volume has become zero.

According to the above-described steps, the same action and effect as those of the above-described first aspect can be yielded.

A fifteenth aspect is a method for controlling a liquid supply system which comprises a pump, a supply and discharge section, a section valve, a discharge valve, a pressure sensor, a flow rate sensor, and a control section, where the pump includes a pump chamber into which a liquid supplied from a liquid container flows and from which the liquid flows out, a working chamber into which a working gas is supplied and from which the working gas is discharged, and a fluctuating member which separates the pump chamber and the working chamber from each other, the pump configured to suck and discharge the liquid in accordance with change in a volume of the pump chamber caused by fluctuation of the fluctuating member. The supply and discharge section is configured to supply the working gas to the working chamber and discharge the working gas from the working chamber. The suction valve is configured to open and close an inflow passage through which the liquid flows into the pump chamber. The discharge valve is configured to open and close a discharge passage through which the liquid flows out of the pump chamber. The pressure sensor is configured to detect pressure within a space including the working chamber. The flow rate sensor is configured to detect flow rate of the working gas supplied to the working chamber. The method comprises the steps of closing the suction valve and opening the discharge valve, calculating a change in a volume of the working chamber on the basis of the flow rate detected by the flow rate sensor, controlling the supply and discharge section such that the calculated change in the volume becomes zero, and using, as an estimated discharge-side hydraulic head pressure of the liquid, the pressure detected by the pressure sensor in a state in which the change in the volume has become zero.

According to the above-described steps, the same action and effect as those of the above-described sixth aspect can be yielded.

A broader aspect which encompasses the fourteenth and sixteenth aspects is a method for controlling, through use of a control section, a liquid supply system which comprises a pump, a supply and discharge section, a section valve, a discharge valve, a pressure sensor, a flow rate sensor, and a control section, as described below:

The pump includes a pump chamber into which a liquid supplied from a liquid container flows and from which the liquid flows out, a working chamber into which a working gas is supplied and from which the working gas is discharged, and a fluctuating member which separates the pump chamber and the working chamber from each other, the pump configured to suck and discharge the liquid in accordance with change in a volume of the pump chamber caused by fluctuation of the fluctuating member. The supply and discharge section is configured to supply the working gas to the working chamber and discharge the working gas from the working chamber. The suction valve is configured to open and close an inflow passage through which the liquid flows into the pump chamber. The discharge valve is configured to open and close a discharge passage through which the liquid flows out of the pump chamber. The pressure sensor is configured to detect pressure within a space including the working chamber. The flow rate sensor is configured to detect flow rate of the working gas which flows into and flows out of the working chamber. The method comprises the steps of: closing a first valve which is one of the discharge valve and the suction valve and opening a second valve which is the other of the discharge valve and the suction valve; calculating a change in a volume of the working chamber on the basis of the flow rate detected by the flow rate sensor; controlling the supply and discharge section such that the calculated change in the volume becomes zero; and using, as an estimated hydraulic head pressure of the liquid on the second valve side, the pressure detected by the pressure sensor in a state in which the change in the volume has become zero.

What is claimed is:

1. A liquid supply system comprising:

a pump which includes a pump chamber into which a liquid supplied from a liquid container flows and from which the liquid flows out, a working chamber into which a working gas is supplied and from which the working gas is discharged, and a movable member which separates the pump chamber and the working chamber from each other, the pump being configured to suck and discharge the liquid in accordance with a change in a volume of the pump chamber caused by a displacement of the movable member;

a supply and discharge section configured to supply the working gas to the working chamber and discharge the working gas from the working chamber;

a suction valve configured to open and close an inflow passage through which the liquid flows into the pump chamber;

a discharge valve configured to open and close a discharge passage through which the liquid flows out of the pump chamber;

a pressure sensor configured to detect a pressure within a space including the working chamber;

a flow rate sensor configured to detect a flow rate of the working gas which flows into and flows out of the working chamber; and a control section configured to control the supply and discharge section, the suction valve, and the discharge valve, wherein the control section is configured to close a first valve which is one of the suction valve and the discharge valve and open a second valve which is the other of the suction valve and the discharge valve, calculate a change in a volume of the working chamber on the basis of the flow rate detected by the flow rate sensor, control the supply and discharge section such that the calculated change in the volume becomes zero in a state in which the first valve is closed and the second valve is open, and obtain an estimated hydraulic head pressure of the liquid on the second valve side by the pressure detected by the pressure sensor when the change in the volume becomes zero.

2. The liquid supply system according to claim 1, wherein, when the control section is configured to close the first valve and open the second valve and change the pressure within the space including the working chamber by controlling the supply and discharge section, the control section being configured to calculate a pressure change amount on the basis of the pressure detected by the pressure sensor and a flow rate change amount on the basis of the flow rate detected by the flow rate sensor, and estimate a relation coefficient on the second valve side which represents a relation between the pressure within the space including the working chamber and the flow rate of the liquid on the basis of the pressure change amount and the flow rate change amount.

3. The liquid supply system according to claim 1, wherein the first valve is the discharge valve and the second valve is the suction valve.

4. The liquid supply system according to claim 3, wherein the control section is configured to set, on the basis of an estimated suction-valve-side hydraulic head pressure and an estimated suction-valve-side relation coefficient, a target pressure within the space including the working chamber when the liquid is sucked, and control the supply and discharge section such that the pressure detected by the pressure sensor coincides with the target pressure.

5. The liquid supply system according to claim 3, wherein a filter for the liquid is provided in the inflow passage, and the control section is configured to report deterioration of the filter on the basis of an estimated suction-valve-side relation coefficient.

6. The liquid supply system according to claim 3, wherein the control section is configured to close the suction valve and open the discharge valve, calculate a change in the volume of the working chamber on the basis of the flow rate detected by the flow rate sensor, control the supply and discharge section such that the change in the volume becomes zero, and use, as an estimated discharge-valve-side hydraulic head pressure of the liquid, the pressure detected by the pressure sensor in a state in which the change in the volume has become zero.

7. The liquid supply system according to claim 1, wherein the first valve is the suction valve and the second valve is the discharge valve.

8. The liquid supply system according to claim 7, wherein the control section is configured to set, on the basis of an estimated discharge-valve-side hydraulic head pressure and an estimated discharge-valve-side relation coefficient, a target pressure within the space including the working chamber when the liquid is discharged, and control the supply and discharge section such that the pressure detected by the pressure sensor coincides with the target pressure.

9. The liquid supply system according to claim 1, wherein, when the control section controls the supply and discharge section such that the change in the volume becomes zero, the control section controls the supply and discharge section so as to raise the pressure within the working chamber in the case where the volume of the working chamber has decreased and controls the supply and discharge section so as to lower the pressure within the working chamber in the case where the volume of the working chamber has increased.

10. The liquid supply system according to claim 1, wherein, when the control section controls the supply and discharge section such that the change in the volume becomes zero, the control section controls the supply and discharge section such that the greater the rate at which the volume of the working chamber decreases, the greater the degree to which the pressure within the working chamber is raised and such that the greater the rate at which the volume of the working chamber increases, the greater the degree to which the pressure within the working chamber is lowered.

11. The liquid supply system according to claim 1, wherein, when the control section closes the discharge valve and the suction valve and changes the pressure within the space including the working chamber by controlling the supply and discharge section, the control section calculates a pressure change amount on the basis of the pressure detected by the pressure sensor and an integrated flow rate on the basis of the flow rate detected by the flow rate sensor, calculates a current volume of the space including the working chamber on the basis of the pressure change amount and the integrated flow rate, and estimates, on the basis of the current volume, a maximum volume of the liquid which can be discharged at the present moment when the liquid is discharged.

12. The liquid supply system according to claim 11, wherein, in the case where, when the discharge of the liquid by the pump is started, the estimated maximum volume is smaller than a demanded volume of the liquid to be discharged, the control section controls the supply and discharge section to cause the pump to suck the liquid so that the pump can discharge the demanded volume of the liquid.

13. The liquid supply system according to claim 1, wherein the control section estimates the hydraulic head pressure under a condition that the control section has controlled the supply and discharge section so as to move the movable member to a position where a tension generated in the movable member becomes smaller than a predetermined value.

14. The liquid supply system according to claim 1, wherein, when the control section closes the discharge valve and the suction valve and changes the pressure within the space including the working chamber to a first pressure by controlling the supply and discharge section, the control section calculates a pressure change amount on the basis of the pressure detected by the pressure sensor and an integrated flow rate on the basis of the flow rate detected by the flow rate sensor, and calculates a first current volume of the space including the working chamber on the basis of the pressure change amount and the integrated flow rate; when the control section closes the discharge valve and the suction valve and changes the pressure within the space including the working chamber to a second pressure by controlling the supply and discharge section, the control section calculates a pressure change amount on the basis of the pressure detected by the pressure sensor and an integrated flow rate on the basis of the flow rate detected by the flow rate sensor, and calculates a second current volume of the space including the working chamber on the basis of the pressure change amount and the integrated flow rate; and the control section estimates the volume of the bubbles within the pump chamber at the first pressure or the volume of the bubbles within the pump chamber at the second pressure on the basis of the first pressure, the second pressure, the first current volume, and the second current volume.

15. The liquid supply system according to claim 1, wherein the control section estimates the hydraulic head pressure on the second valve side by the pressure detected by the pressure sensor when the change in the volume has become zero by controlling the supply and discharge section while the first valve is closed and the second valve is open, under a condition in which the movable member has moved to a neutral position where a tension generated in the movable member is smaller than a predetermined value.

16. A method for controlling a liquid supply system which comprises: a pump including a pump chamber into which a liquid supplied from a liquid container flows and from which the liquid flows out, a working chamber into which a working gas is supplied and from which the working gas is discharged, and a movable member which separates the pump chamber and the working chamber from each other, the pump being configured to suck and discharge the liquid in accordance with a change in a volume of the pump chamber caused by a displacement of the movable member;

a supply and discharge section configured to supply the working gas to the working chamber and discharge the working gas from the working chamber; a suction valve configured to open and close an inflow passage through which the liquid flows into the pump chamber; a discharge valve configured to open and close a discharge passage through which the liquid flows out of the pump chamber; a pressure sensor configured to detect a pressure within a space including the working chamber; a flow rate sensor configured to detect a flow rate of the working gas which flows into and flows out of the working chamber; and a control section, the method being performed by the control section, the method comprising the steps of:

closing a first valve which is one of the discharge valve and the suction valve and opening a second valve which is the other of the discharge valve and the suction valve;

calculating a change in a volume of the working chamber on the basis of the flow rate detected by the flow rate sensor;

controlling the supply and discharge section such that the calculated change in the volume becomes zero in a state in which the first valve is closed and the second valve is open; and obtaining an estimated hydraulic head pressure of the liquid on the second valve side by the pressure detected by the pressure sensor when the change in the volume becomes zero.

17. The liquid supply system control method according to claim 16, wherein the first valve is the discharge valve and the second valve is the suction valve.

18. The liquid supply system control method according to claim 16, wherein the first valve is the suction valve and the second valve is the discharge valve.

* * * * *